US008832874B2

(12) United States Patent
Alexander

(10) Patent No.: US 8,832,874 B2
(45) Date of Patent: Sep. 16, 2014

(54) PERSON MOVING DEVICES FOR MOVING PERSONS OF LIMITED MOBILITY

(76) Inventor: Keith Vivian Alexander, Christchurch (NZ)

( * ) Notice: Subject to any disclaimer, the term of this patent is extended or adjusted under 35 U.S.C. 154(b) by 0 days.

(21) Appl. No.: 13/381,494

(22) PCT Filed: Jun. 29, 2010

(86) PCT No.: PCT/NZ2010/000129
§ 371 (c)(1),
(2), (4) Date: Dec. 29, 2011

(87) PCT Pub. No.: WO2011/002312
PCT Pub. Date: Jan. 6, 2011

(65) Prior Publication Data

US 2012/0104711 A1 May 3, 2012

(30) Foreign Application Priority Data

Jun. 29, 2009 (NZ) ..... 578039

(51) Int. Cl.
*A61G 7/14* (2006.01)
*A61G 7/10* (2006.01)
*A61G 3/02* (2006.01)

(52) U.S. Cl.
CPC ..... *A61G 7/1017* (2013.01); *A61G 7/1046* (2013.01); *A61G 3/0236* (2013.01)
USPC ..... 5/81.1 R; 280/47.34; 280/657; 254/10 R

(58) Field of Classification Search
CPC ..... A61G 3/0236; A61G 3/0245; A61G 5/14; A61G 7/10; A61G 7/1017; A61G 7/1025; A61G 7/1036; A61G 7/1038; A61G 7/1046
USPC ..... 280/47.34, 47.17, 47.131, 47.18; 5/81.1 R; 414/921; 254/10 R
See application file for complete search history.

(56) References Cited

U.S. PATENT DOCUMENTS 1,751,480 A * 3/1930 Howell ..... 254/7 R
2,354,845 A * 8/1944 Thornton ..... 280/35
(Continued)

FOREIGN PATENT DOCUMENTS

EP 626840 B1 * 12/1997
EP 1772132 4/2007
(Continued)

*Primary Examiner* — J. Allen Shriver, II
*Assistant Examiner* — Steve Clemmons
(74) *Attorney, Agent, or Firm* — Dann, Dorfman, Herrell and Skillman, P.C.

(57) ABSTRACT

A person moving device for moving a person of limited mobility. The device comprises a lower floor engaging frame part (1) and an upper patient carrying part (6) adapted to carry a patient by engaging the patient's torso from the front and which is mounted to the lower frame part for movement between a patient load-unload position and a patient transport position. The upper patient carrying part being mounted to the lower frame part for curvilinear movement about an axis extending across the patient and positioned so that the patient's torso moves substantially by rolling about an axis across the device and the patient and substantially about a center of mass of the patient. A handle (12) is also provided by which a user can cause the upper patient carrying 10 part to move from the load-unload position to the transport position.

18 Claims, 43 Drawing Sheets

(56) References Cited

U.S. PATENT DOCUMENTS

| | | | | | |
|---|---|---|---|---|---|
| 2,914,110 | A | * | 11/1959 | Schulte | 297/411.1 |
| 3,189,345 | A | * | 6/1965 | Simpson | 482/67 |
| 3,291,448 | A | * | 12/1966 | Beebe | 254/10 R |
| 3,306,579 | A | * | 2/1967 | Campbell | 254/10 R |
| 4,435,863 | A | * | 3/1984 | Lerich | 5/87.1 |
| 4,510,633 | A | * | 4/1985 | Thorne | 5/87.1 |
| 4,682,377 | A | | 7/1987 | Reich | |
| 4,985,947 | A | * | 1/1991 | Ethridge | 5/86.1 |
| 5,001,789 | A | | 3/1991 | Schoenberger | |
| 5,093,944 | A | | 3/1992 | Winston, Sr. | |
| 5,117,516 | A | * | 6/1992 | Penner | 5/86.1 |
| 5,189,741 | A | * | 3/1993 | Beardmore | 5/86.1 |
| 5,233,708 | A | | 8/1993 | Winston, Sr. | |
| 5,257,425 | A | | 11/1993 | Shinabarger | |
| 5,286,046 | A | * | 2/1994 | Bottemiller et al. | 280/47.38 |
| 5,596,775 | A | * | 1/1997 | DiMatteo et al. | 5/81.1 C |
| 5,762,402 | A | * | 6/1998 | Gillotti | 297/423.11 |
| 5,950,258 | A | | 9/1999 | Deyne et al. | |
| 6,112,345 | A | * | 9/2000 | Foster et al. | 5/81.1 R |
| 6,134,725 | A | * | 10/2000 | Bouhuijs | 5/86.1 |
| 6,175,973 | B1 | * | 1/2001 | Hakamiun et al. | 5/89.1 |
| 6,186,728 | B1 | * | 2/2001 | Michaud | 414/458 |
| 6,308,981 | B1 | * | 10/2001 | Proehl | 280/657 |
| 6,389,619 | B1 | * | 5/2002 | Dunn | 5/86.1 |
| 6,568,003 | B1 | * | 5/2003 | Vest | 5/89.1 |
| 6,718,573 | B2 | * | 4/2004 | Von Schroeter | 5/86.1 |
| 7,506,388 | B1 | * | 3/2009 | Brown | 5/86.1 |
| 2003/0110561 | A1 | | 6/2003 | Porcheron | |
| 2010/0251480 | A1 | * | 10/2010 | Orrico et al. | 5/81.1 RP |

FOREIGN PATENT DOCUMENTS

| | | | | | |
|---|---|---|---|---|---|
| GB | 2296901 | A | * | 7/1996 | |
| JP | 2000296154 | A | * | 10/2000 | A61G 5/00 |
| JP | 2003-325582 | | | 11/2003 | |
| WO | WO 9115178 | A1 | * | 10/1991 | |
| WO | WO 9611658 | A1 | * | 4/1996 | |
| WO | 01/21128 | | | 3/2001 | |
| WO | 2010/019306 | | | 2/2010 | |

* cited by examiner

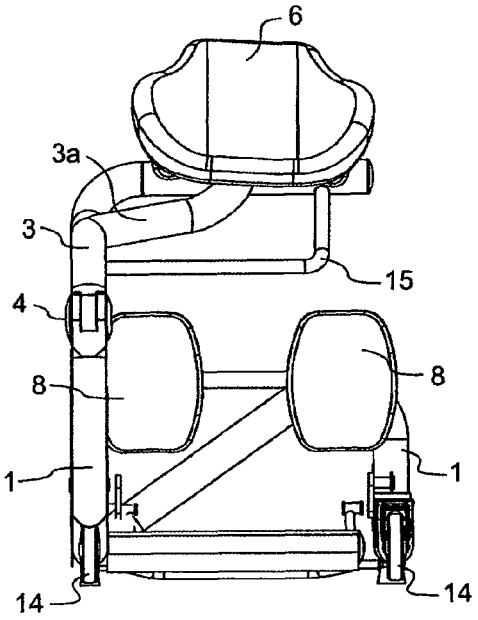
FIGURE 21
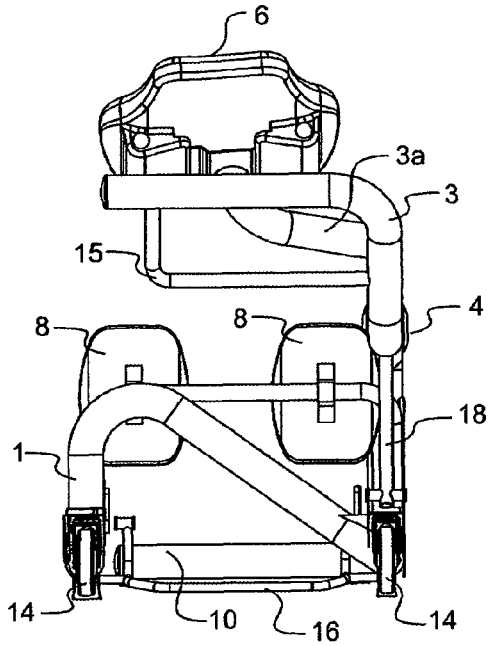
FIGURE 22
FIGURE 23
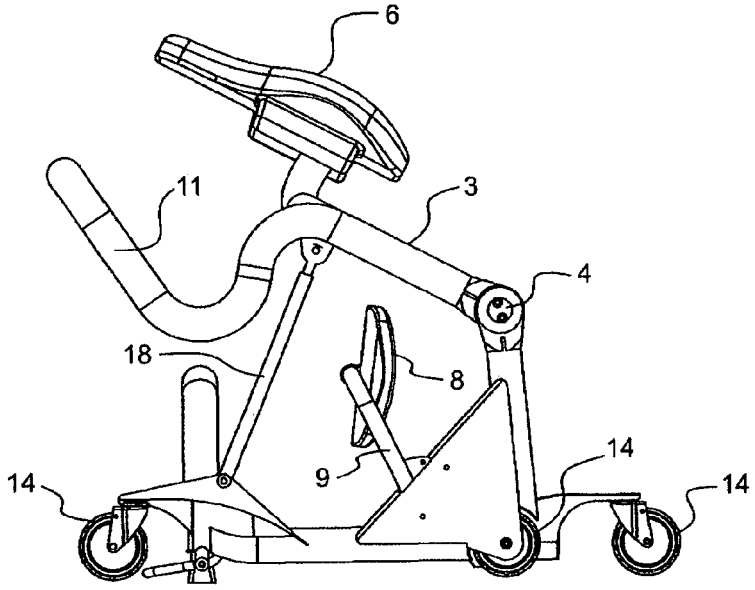

PERSON MOVING DEVICES FOR MOVING PERSONS OF LIMITED MOBILITY

FIELD OF THE INVENTION

The invention relates to person moving devices for moving persons of limited mobility such as elderly or infirm or disabled persons.

BACKGROUND TO THE INVENTION

In a hospital or nursing home for example there is regularly a need to move elderly or infirm or disabled persons who are unable to stand up and/or walk themselves, from place to place such as from a bed to a chair or to a lavatory or vice versa. A wheelchair may be used but other forms of patient moving devices designed to facilitate getting the patient onto and from a bed or chair are known in which this can be done more readily than with a wheelchair (which generally requires significant lifting of the patient, by a caregiver or caregivers). Such patient moving devices may also be lower cost than a wheelchair, and can be useful when nursing elderly or infirm or disabled persons in the home for example.

Moving one person by another requires significant strength of the caregiver (mover), and can run a significant risk of for example back injury to the caregiver through lifting often accompanied by bending.

It is an object of the present invention to provide an improved patient mover that is easier for a carer to operate, or to at least provide the public with a useful choice.

SUMMARY OF THE INVENTION

In a first aspect, the present invention broadly consists in a person moving device (patient mover) for moving a person of limited mobility, which comprises: a lower floor engaging frame part, an upper patient carrying part adapted to carry a patient by engaging the patient's torso from the front, mounted to the lower frame part for movement between a patient load-unload position and a patient transport position in which the patient's buttocks are elevated relative to the load-unload position, the upper patient carrying part being mounted to the lower frame part for curvilinear movement about an axis extending across the patient and positioned so that the patient's torso moves substantially by rolling about an axis across the device and the patient and substantially about a centre of mass of the patient, and a handle by which a user can cause the upper patient carrying part to move from the load-unload position to the transport position.

In a first form, the upper patient carrying part is movably mounted to the lower frame part by a 4-bar linkage. Preferably, the handle is operatively connected to the 4-bar linkage, and the 4-bar linkage is configured such that movement of the handle causes the 4-bar linkage to move the upper patient carrying part between the load-unload and transport positions.

Preferably, the 4-bar linkage comprises lower first and second links that are each pivotably connected to the lower frame part at one end, the opposite ends of the lower first and second links being pivotably connected to respective ends of upper first and second links, the opposite ends of the upper first and second links being pivotably connected to the upper patient carrying part. More preferably, the handle extends from a handle mounting component fixed to the lower first link and wherein the handle mounting component is further pivotably connected to the upper second link at a position intermediate of its length.

Preferably, the lower and upper second links are longer than their respective lower and upper first links.

Preferably, the lower first and second links maintain a substantially parallel and spaced-apart relationship throughout the 4-bar linkage movement.

Preferably, the 4-bar linkage moves toward a collapsed state when moving toward the transport position, and an un-collapsed state when moving toward the load-unload position.

In a second form, the upper patient carrying part is movably mounted to the lower frame part by a pivot mechanism and at least one slider mechanism.

Preferably, the pivot mechanism comprises a pivot bar that is pivotably connected at one end to the lower frame part and the handle being mounted at or toward the opposite end of the pivot bar, and spaced-apart upper and lower connecting members each being pivotably connected at one end to the pivot bar and the opposite ends being pivotably connected to the underside of the upper patient carrying part at respective opposite upper and lower regions of the upper patient carrying part.

Preferably, the slider mechanism comprises: an elongate guide component that is mounted to the lower frame part so as to extend at a substantially horizontal or more horizontal than vertical orientation; and a slider member that is pivotably connected at a first end to the underside and in the lower region of the upper patient carrying part and is operatively connected a second end to the guide component for linear slidable movement relative the guide component.

Preferably, the slider member is configured for telescopic movement relative to the guide component. More preferably, the guide component is elongate and substantially hollow for receiving and retaining at least the second end of the slider member for reciprocating slidable movement back and forth within and along the guide component. In one embodiment, the slider member and/or guide component is provided with one or more rollers that are arranged to rollably engage with either the slider member or guide component to assist slidable movement of the slider member relative to the guide component.

In one form, the guide component is fixedly mounted at one end to the lower frame component in a cantilever fashion. In another form, the guide component is pivotably mounted at one end to the lower frame component and the device further comprising a length adjustable support strut extending between the lower frame part and the guide component so as to enable the orientation of the guide component to be adjusted relative to the horizontal.

Preferably, the pivot mechanism and slider mechanism operate to move in planes that are coincident or parallel to the central line of symmetry of the device.

Preferably, the pivot mechanism is centrally mounted on the patient mover and there are two slider mechanisms, each slider mechanism being located on an opposite side of the pivot mechanism to the other.

More preferably, the pivot mechanism and slider mechanism(s) are configured to co-operate to cause a lower region of the upper patient carrying part to linearly translate substantially horizontally while an upper region of the upper patient carrying part simultaneously moves in a curvilinear path in response to movement of the handle between the load-unload and transport positions.

In a third form, the upper patient carrying part is slidably mounted to the lower frame part.

Preferably, upper patient carrying part is slidably mounted to the lower frame part by a slider mechanism that comprises a curved member that extends between an upper end upon which the upper patient carrying part is mounted and a lower end, the curved member being slidably mounted to the lower frame part for curvilinear movement. More preferably, the handle extends from the upper patient carrying part or a location at or toward the upper end of the curved member.

Preferably, the lower frame part comprises a central upright member upon which one or more mounting components are provided for operatively connecting to the curved member to allow for slidable movement.

Preferably, each mounting component has a guide aperture through which the curved member slidably extends. More preferably, each mounting component is provided with one or more bearings in the vicinity of its guide aperture for contacting a surface of the curved member to assist in slidable movement of the curved member through the guide aperture. In one embodiment, the bearings are in the form of rollers that are configured to rollably engage with a surface of the curved member as it extends through the guide aperture of the mounting component.

Preferably, the curved member is provided with one or more stop components are arranged to engage with a part(s) of the lower frame part so as to limit the slidable movement of the curved member relative to the lower frame part such that the corresponding curvilinear movement of the upper patient carrying part is limited to between the load-unload and transport positions.

In a fourth form, the upper patient carrying part is telescopically mounted to the lower frame part.

Preferably, the upper patient carrying part is fixed to an upper frame part that is telescopically mounted to the lower frame part. More preferably, the lower frame part comprises two spaced-apart curved upright elements and the upper frame part comprises two spaced-apart curved elements that are each telescopically mounted to a respective one of the curved upright elements of the lower frame part, the curved elements of the upper frame part being joined together by a cross-part at the opposite ends to the lower frame part, the upper patient carrying part being mounted to the cross part.

Preferably, the curvilinear movement of the upper patient carrying part follows an arc centered about a virtual axis. More preferably, the arc is defined by the movement of a point on the upper patient carrying part that abuts the top of the patient's sternum and the virtual axis is passes through or is parallel with a line across the patient when the patient is in the load-unload position intermediate between two vertical planes coincident with the knee and hip joints of the patient.

Even more preferably, the virtual axis passes through the center $\frac{1}{3}^{rd}$ of the distance between the two vertical planes coincident with the knee and hip joints of the patient when the patient is in the load-unload position.

Preferably, any vertical movement of the center of mass of the patient when moving from the load-unload position to the transport position, or vice versa, is less than approximately 5% of the height of the patient, or more preferably less than approximately 2% of the height of the patient.

Preferably, any vertical movement of the center of mass of the patient when moving from the load-unload position to the transport position, or vice versa, is not more than approximately 85 mm, and more preferably is not more than approximately 35 mm.

Preferably, the lower frame part comprises a floor for supporting the patient's feet.

Preferably, the lower frame part comprises a lower leg contacting part or parts for supporting each of the patient's lower legs. More preferably, the lower leg contacting part(s) are adjustable in position on the lower frame part.

Preferably, the device further comprises an operable latching mechanism that is operable by a user to lock the upper patient carrying part in one or more positions relative to the lower frame part.

Preferably, the lower frame part comprises one or more ground wheels for transporting the device over the ground.

In one form, the upper patient carrying part is in the form of a cradle. More preferably, the cradle comprises upwardly extending arms on either side of the cradle to assist in locating the patient. In another form, the upper patient carrying part is in the form of a chest pad that is shaped for supporting a patient's torso.

Preferably, the device further comprises one or more patient handles for the patient to grip mounted in the vicinity of the upper patient carrying part.

Preferably, the device further comprises one or more stop mechanisms that are configured to limit the range of movement of the upper patient carrier part relative to the lower frame part to between the load-unload and transport positions.

In a second aspect, the present invention broadly consists in a person moving device (patient mover) for moving a person of limited mobility, which comprises: a lower floor engaging frame part, an upper patient carrying part adapted to carry a patient by engaging the patient's torso from the front, mounted to the lower frame part by a 4-bar linkage for movement between a patient load-unload position and a patient transport position in which the patient's buttocks are elevated relative to the load-unload position, and a handle operatively connected to the 4-bar linkage or upper patient carrying device by which a user can cause the upper patient carrying part to move from the load-unload position to the transport position.

Preferably, the 4-bar linkage is configured such that the upper patient carrying part is mounted to the lower frame part for curvilinear movement about an axis extending across the patient and positioned so that the patient's torso moves substantially by rolling about an axis across the device and the patient and substantially about a centre of mass of the patient.

Preferably, the 4-bar linkage comprises lower first and second links that are each pivotably connected to the lower frame part at one end, the opposite ends of the lower first and second links being pivotably connected to respective ends of upper first and second links, the opposite ends of the upper first and second links being pivotably connected to the upper patient carrying part. More preferably, the handle extends from a handle mounting component fixed to the lower first link and wherein the handle mounting component is further pivotably connected to the upper second link at a position intermediate of its length.

Preferably, the lower and upper second links are longer than their respective lower and upper first links.

Preferably, the lower first and second links maintain a substantially parallel and spaced-apart relationship throughout the 4-bar linkage movement.

Preferably, the 4-bar linkage moves toward a collapsed state when moving toward the transport position, and an un-collapsed state when moving toward the load-unload position.

In a third aspect, the present invention broadly consists in a person moving device (patient mover) for moving a person of limited mobility, which comprises: a lower floor engaging frame part, an upper patient carrying part adapted to carry a patient by engaging the patient's torso from the front, pivotably mounted to the lower frame part for movement between a patient load-unload position and a patient transport position in which the patient's buttocks are elevated relative to the load-unload position, about a pivot axis extending across the patient and positioned so that the patient's torso moves substantially by rolling about an axis across the device and the patient and substantially about a centre of mass of the patient, and a handle by which a user can cause the upper frame part carrying a patient to pivotally move from the load-unload position to the transport position.

Preferably, the upper patient carrying part is fixed to an upper frame part that is pivotably mounted to the lower frame part at the pivot axis.

In one form, the upper frame part is pivotably connected to the lower frame part at a single pivot connection located at or toward a side of the device. In another form, the upper frame part is pivotably connected to the lower frame part by two-spaced apart pivot connections, each located at or toward opposite sides of the device.

Preferably, the pivot axis is located in the central third of the distance between two vertical planes, one passing through a patient's knees and the other through a patient's hips, when the patient is on the device in the load-unload position.

Preferably, any vertical movement of the center of mass of the patient when moving from the load-unload position to the transport position, or vice versa, is less than approximately 5% of the height of the patient, and more preferably is less than approximately 2% of the height of the patient.

Preferably, any vertical movement of the center of mass of the patient when moving from the load-unload position to the transport position, or vice versa, is not more than approximately 85 mm, and more preferably is not more than approximately 35 mm.

Preferably, the lower frame part comprises a floor for supporting the patient's feet.

Preferably, the lower frame part comprises a lower leg contacting part or parts for supporting each of the patient's lower legs. More preferably, the lower leg contacting part(s) are adjustable in position on the lower frame part.

Preferably, the device further comprises an operable latching mechanism that is operable by a user to lock the upper patient carrying part in one or more positions relative to the lower frame part.

Preferably, the lower frame part comprises one or more ground wheels for transporting the device over the ground.

In one form, the upper patient carrying part is in the form of a cradle. Preferably, the cradle comprises upwardly extending arms on either side of the cradle to assist in locating the patient. In another form, the upper patient carrying part is in the form of a chest pad that is shaped for supporting a patient's torso.

Preferably, the device further comprises one or more patient handles for the patient to grip mounted in the vicinity of the upper patient carrying part.

More preferably, the device further comprises one or more stop mechanisms that are to limit the range of movement of the upper patient carrier part relative to the lower frame part to between the load-unload and transport positions.

In a fourth aspect, the present invention broadly consists in a person moving device (patient mover) for moving a person of limited mobility, adapted to carry a patient by engaging the patient's torso and including a lower floor engaging part or parts which is/are curved enabling the moving device to be rolled thereon between a load-unload position and a transport position in which the buttocks of a patient carried by the device are elevated relative to the load-unload position, the device also including a handle by which a user can roll the device carrying a patient from the load-unload position to the transport position.

Preferably, the lower floor engaging part comprises a first section formed with a low or no radius of curvature in a vertical plane and a second section having a decreased radius of curvature or at least cranked away from the first section.

Preferably, the centre of mass of the patient remains at essentially the same height between the load-unload and transport positions.

Preferably, the device further comprising one or more ground wheels which engage the floor at least when the device is in its transport position to enable the device carrying a patient to be moved to transport the patient.

In all aspects, the movement of the patient from the load-unload position to the transport position and from the transport position to the load-unload position may include a component of lifting and lowering respectively of the centre of mass of the patient as well as rolling, but if so the lifting and lowering of the patient is less than 5%, preferably less than 2% of the height of the patient. Preferably the lifting component of movement is not more than 85 mm and more preferably not more than 35 mm in a vertical direction.

By "centre of mass" in relation to the first-third aspects of the invention is meant the centre of mass of the body of a patient or average patient from the patient's head to the patient's knee joints.

By "centre of mass" in relation to the fourth aspect of the invention is meant the centre of mass of the body of a patient or average patient from the patient's head to the patient's feet.

By "patient" is meant a person of height approximately 1.8 m and weight approximately 80 kg. The patient mover may work with persons of other heights and weights but must work with persons of this height and weight.

The term "comprising" as used in this specification and claims means "consisting at least in part of". When interpreting each statement in this specification and claims that includes the term "comprising", features other than that or those prefaced by the term may also be present. Related terms such as "comprise" and "comprises" are to be interpreted in the same manner.

BRIEF DESCRIPTION OF THE DRAWINGS

The invention is further described with reference to the accompanying drawings by way of example, in which FIGS. 20 to 27 illustrate a third embodiment of patient mover of the invention.

FIGS. 1, 11, 20, 30, 39 and 48 are perspective views of the first, second, third, fifth, sixth, and seventh patient movers respectively, FIGS. 2, 12 and 21, 31, 40 and 49 are front elevations (patient view) in the direction of arrow A in FIGS. 1, 11, 20, 30, 39 and 48, of the first, second, third, fifth, sixth, and seventh patient movers, in a transport position, FIGS. 3, 13, 22, 32, 41 and 50 are rear elevations (carer view) in the direction of arrow B in FIGS. 1, 11, 20, 30, 39 and 48, of the patient movers in a transport position, FIGS. 4, 14, 23, 33, 42 and 51 are right side (carer view) elevations of the patient movers in a transport position, FIGS. 5, 15, 24, 34, 43 and 52 are left side elevations of the patient movers in a transport position, FIGS. 6, 16, 25, 35, and 44 are left side (carer view) elevations of the patient movers in a first intermediate position between the load-unload position and transport position (the first intermediate position closest to the transport position), FIG. 53 is a left side (carer view) elevation of the seventh embodiment patient mover in an intermediate position between the load-unload position and transport position, FIGS. 7, 17, 26, 36, and 45 are left elevation views of the patient mover similar to FIGS. 6, 16, 25, 35, 44 but of the patient movers in a second intermediate position, FIGS. 8, 18, 27, 37, 46 and 54 are left side (carer view) elevation views of the patient movers in the load-unload position, FIGS. 9, 19, 38, 47 and 55 are left side elevation views of the first, second, fifth, sixth and seventh patient movers in the transport position showing also the patient movers in the intermediate positions and load-unload position in phantom outline, FIG. 10 schematically shows movement of the centre of mass of a patient during operation of the patient mover of FIGS. 1 to 9, FIG. 28 is a perspective view from the carers viewpoint of a fourth embodiment patient mover in the transport position, and FIG. 29 is a perspective view from the carers viewpoint of a fourth embodiment patient mover in the load-unload position.

DETAILED DESCRIPTION OF EMBODIMENTS

First Embodiment

The first embodiment patient mover of the invention shown in FIGS. 1 to 9 is formed largely of bent metal tube or pipe, but in other embodiments may be otherwise constructed.

Figure 9:
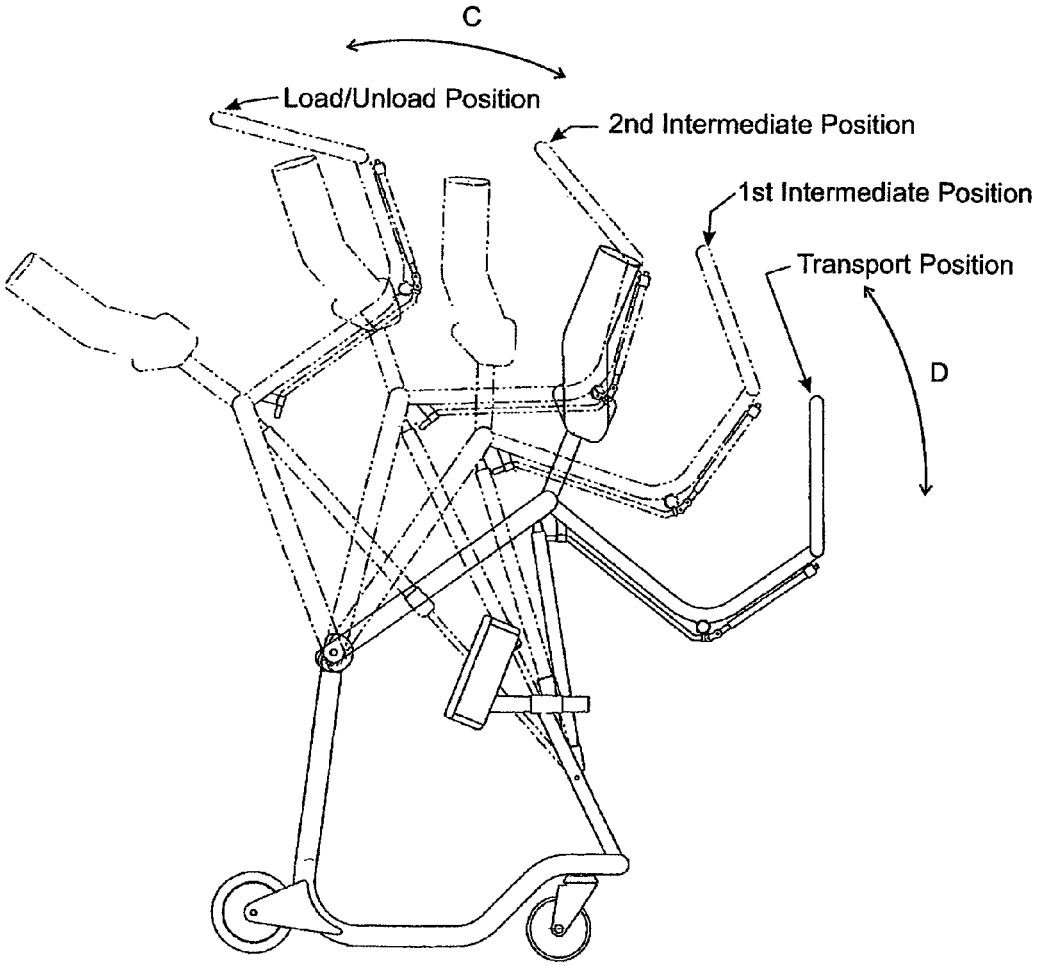

The lower floor engaging frame part has an approximate square u-shape as shown and comprises upright elements 2. The upper frame part is indicated at 3 and is pivotally mounted to the top of the uprights 2 of the lower frame part 1 at spaced pivot points 4, for movement of the upper frame part 3 relative to the lower frame part 1 as indicated by arrow C in some figures, between a load-unload position and transport position, as shown in FIG. 9.

The upper frame part includes a cradle 6 facing a patient side of the device, which is preferably covered with a resiliently compressible material such as a high density foam material or is otherwise padded, and which is positioned to engage the patient's chest when the patient is carried by the patient mover. In the embodiment shown the cradle 6 includes similarly padded arms 7 on either side which assist in locating the patient.

The lower frame part includes a floor 10 being a panel extending across the tubular lower frame 1 as shown, on which in use the patient places his or her feet.

An arm 11 extends from the upper frame part 3 on a carer side of the device and terminates in a handle 12, which may be raised and lowered in the direction of arrow D in some figures to pivot the upper frame part 3 between the transport and load-unload positions.

A telescopic strut 18 may be provided between the upper frame part 3 and lower frame part 1 to assist in stabilising the upper frame part 3 and to provide limit stops for movement between the load-unload and transport positions particularly when carrying a patient. The device may also include a latch mechanism which is engaged when the upper frame part 3 is returned to the transport position, to lock the upper frame 3 in the transport position until it is unlatched deliberately by the caregiver. For example the latch mechanism may be associated with the telescopic strut and may be released to enable the upper frame part to be moved from the transport position, by a pull 16 mounted below the handle 12 and connected to the latch via a mechanical linkage or cable 17.

The embodiment of patient mover shown is provided with wheels 14 attached to the lower frame part 1 which enable the mover carrying a patient to be wheeled from place to place, for example between a bed or a chair or vice versa. For example, the pair of wheels on the patient side of the device may be fixed and the pair of wheels on the carer side of the device swivelable. Wheels is intended to include small rollers on the underside of the lower frame part. In an alternative embodiment again skids or slides instead of wheels may be provided and in a further alternative embodiment in which the patient mover is intended simply to enable a patient to be raised and lowered without movement from place to place the device may not include wheels or skids or equivalent.

Figure 1:
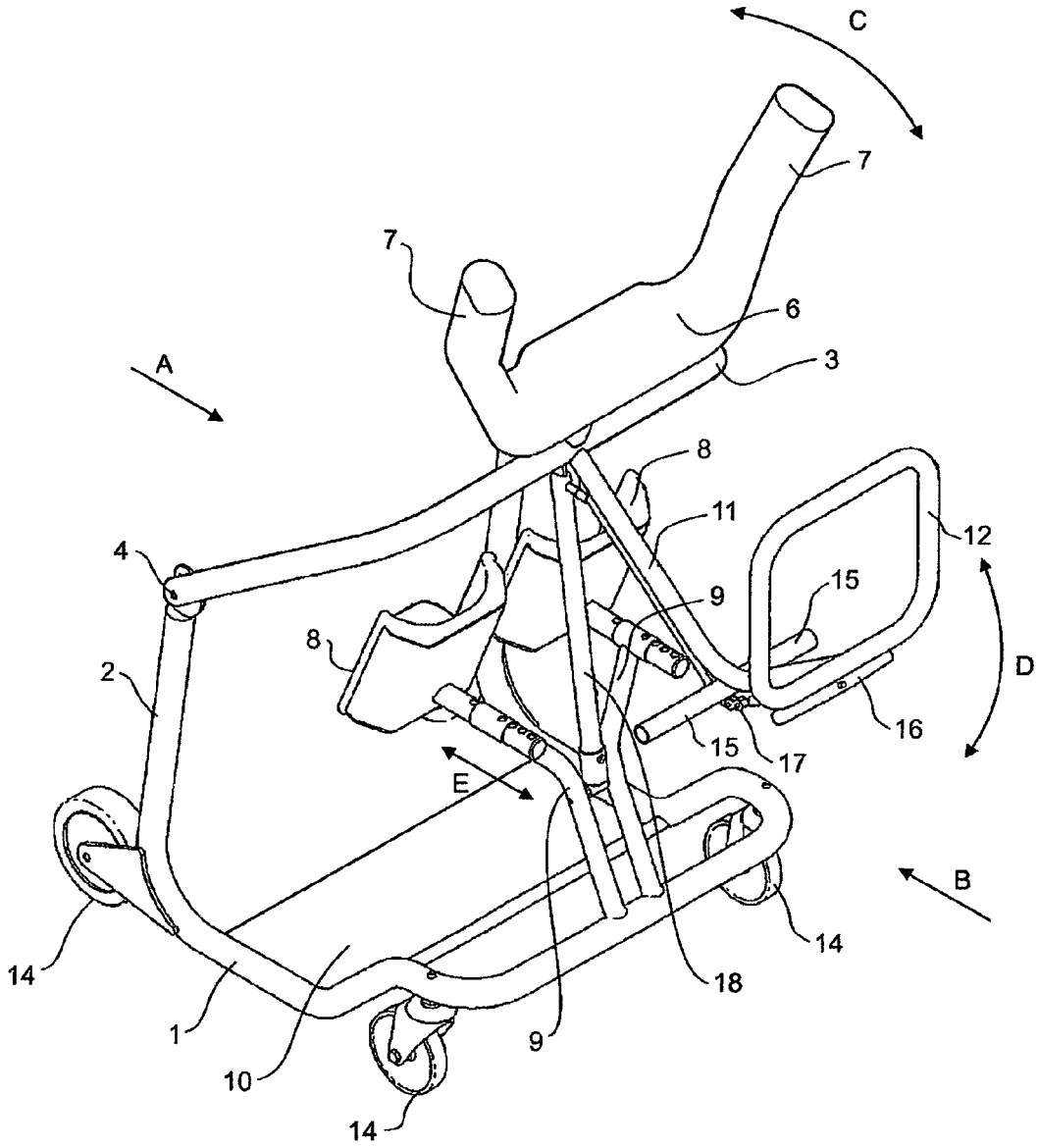
FIGS. 1 to 9 illustrate a first embodiment of patient mover of the invention.
Figure 3:
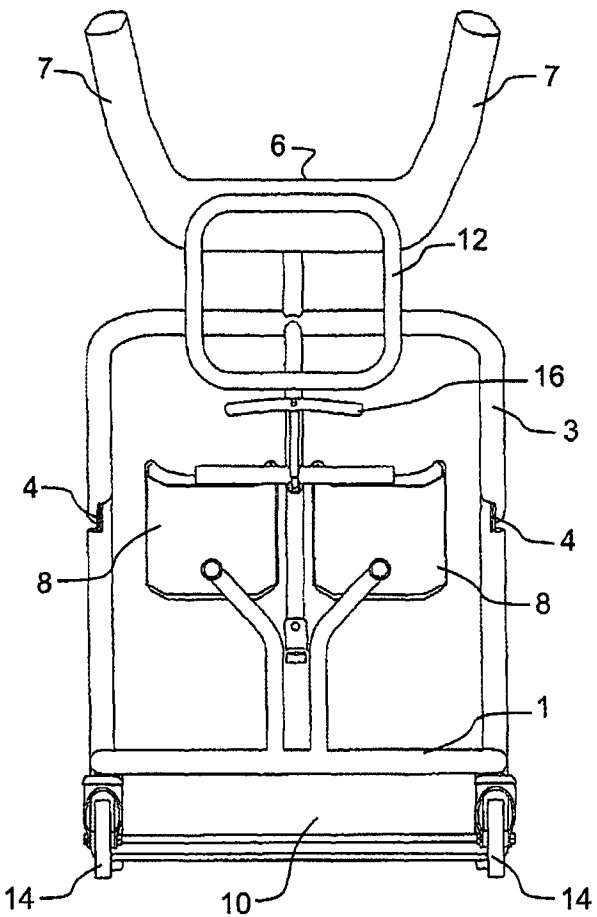
Figure 2:
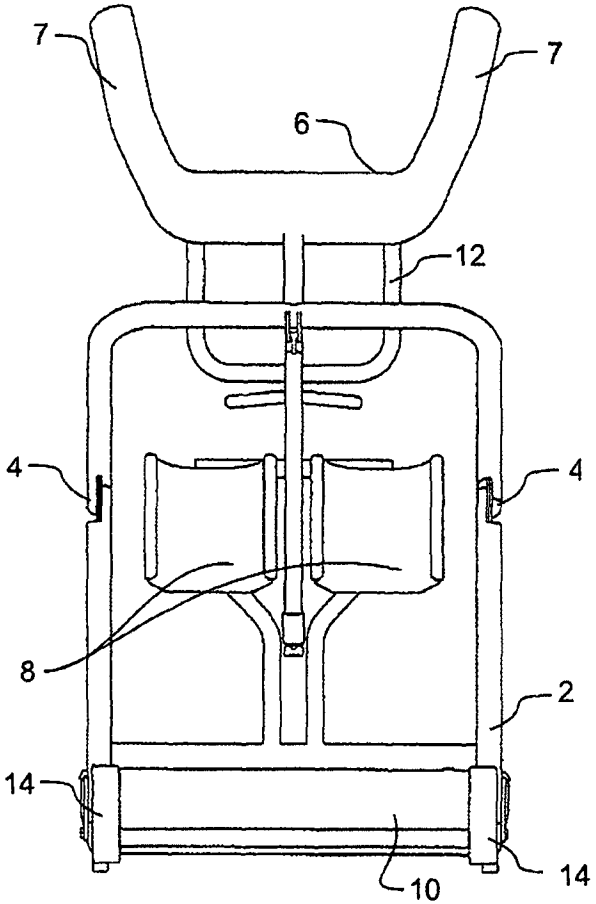
Figure 4:
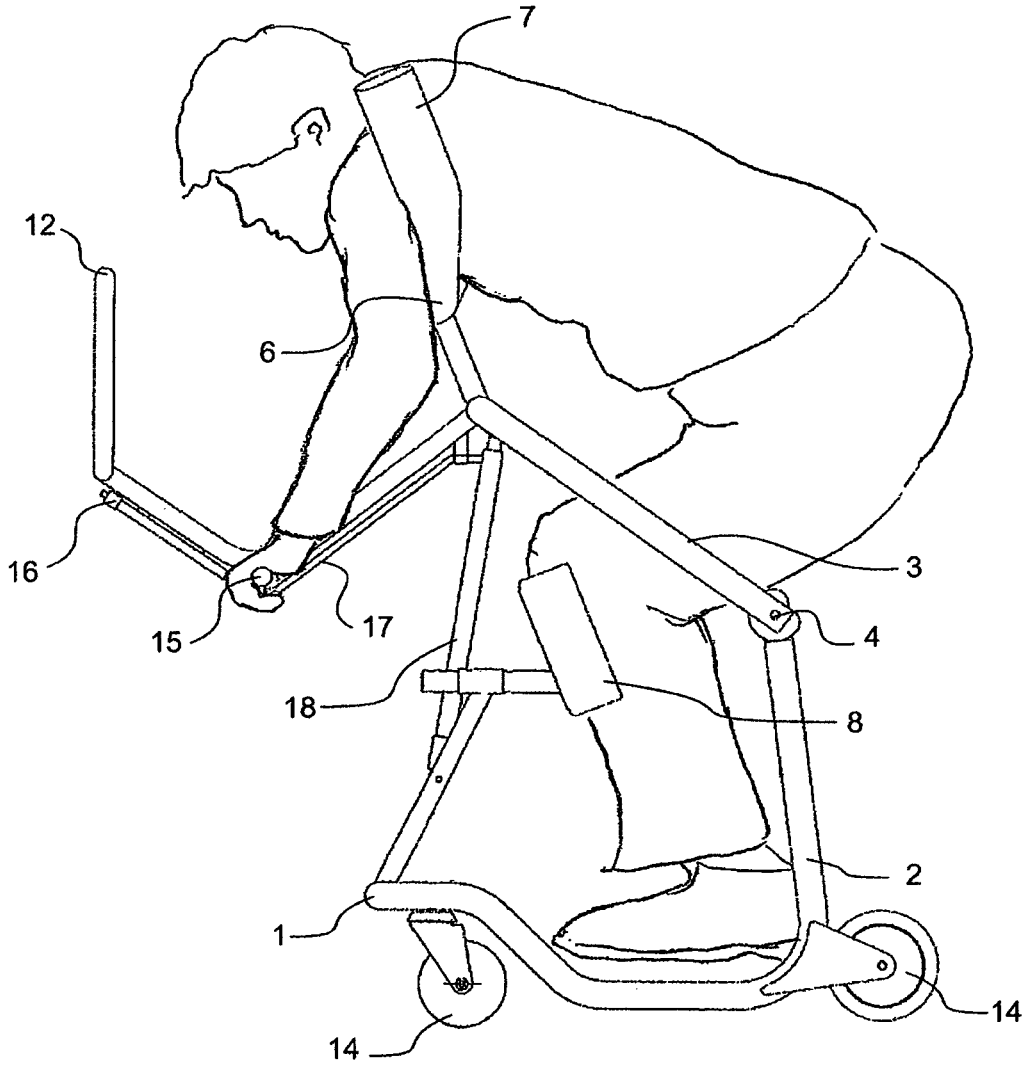
Figure 6:
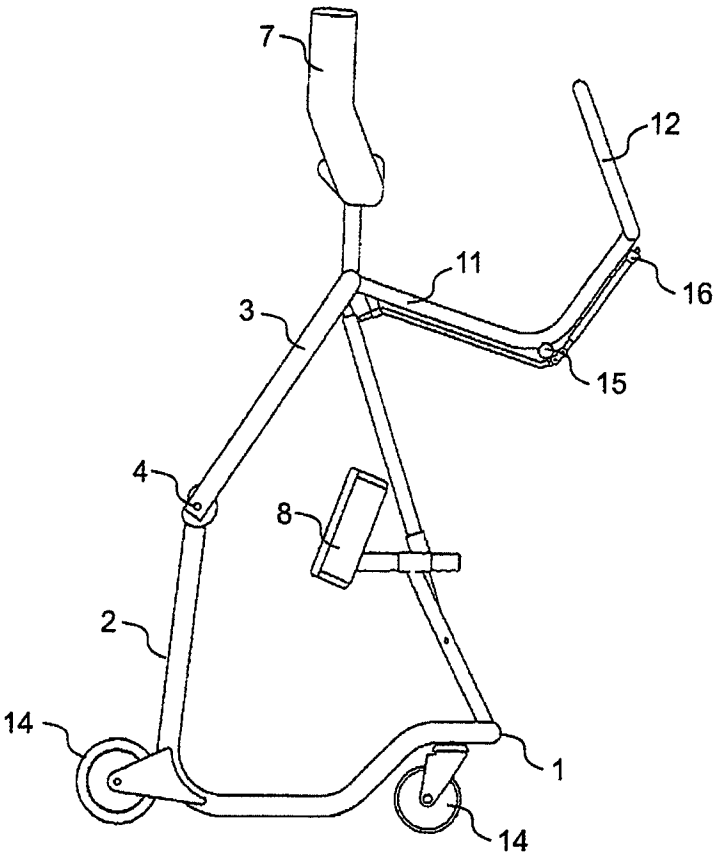
Figure 5:
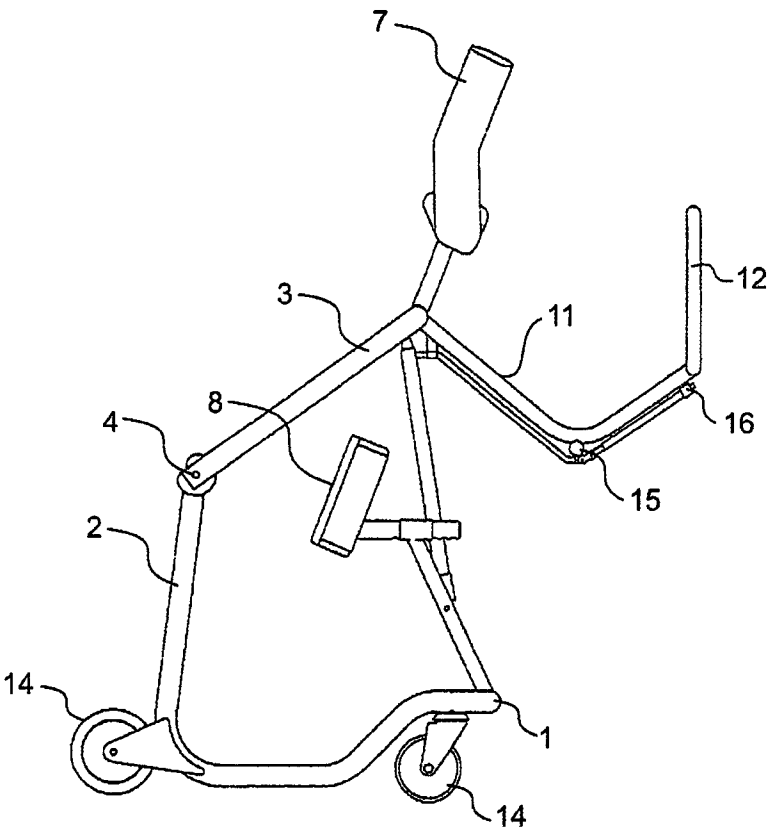
Figure 8:
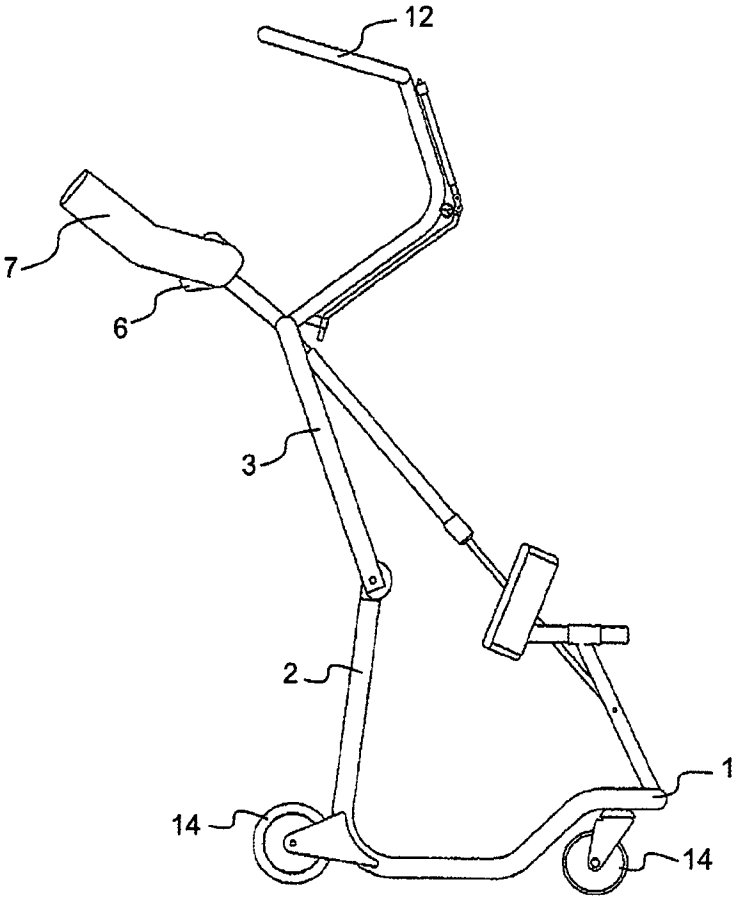
Figure 7:
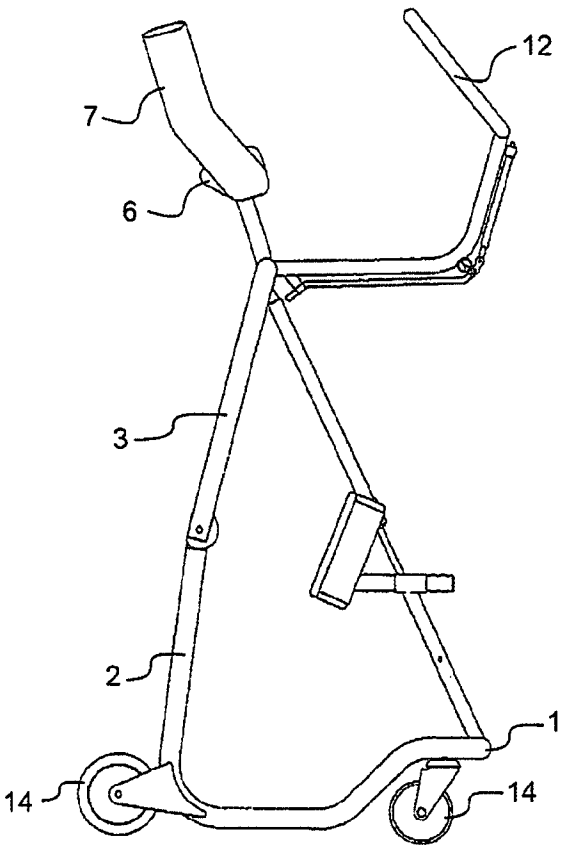

In use the patient mover is moved towards a seated patient, for example a patient sitting on the edge of a bed, in a chair, or on a lavatory, and the handle 11/12 is lifted to the load-unload position. FIG. 8 shows the device in this load-unload position. To move the upper frame from the transport position in other figures to the load-unload position of FIG. 8 the handle 11/12 is raised pivoting the upper frame part 3 and cradle 6/7 towards the patient. The patient is then asked to place his or her feet on the floor 10, lean forward until the patient's chest contacts the cradle 6, and put his or her arms over the cradle 6 between the arms 7, and grasp, or rest the hands on the handles 15 that extend from arm 11. In the preferred form padded lower leg contacting parts 8 are also provided, one on either side of the lower frame 1 to contact and support the lower legs of the patient on the device. The position of the lower leg engaging parts 8 is adjustable in the direction of arrow E in FIG. 1. The caregiver then pushes the handle 11/12 downwardly, to pivot the upper frame part 3 through the first and second intermediate positions shown in FIGS. 6 and 7 and to the transport position shown in FIGS. 1 to 5. This elevates patient's buttocks relative to the load-unload position, by a rolling movement of the patient's torso about an axis or line across the device, more so than by lifting in a vertical direction of the patient.

Figure 10:
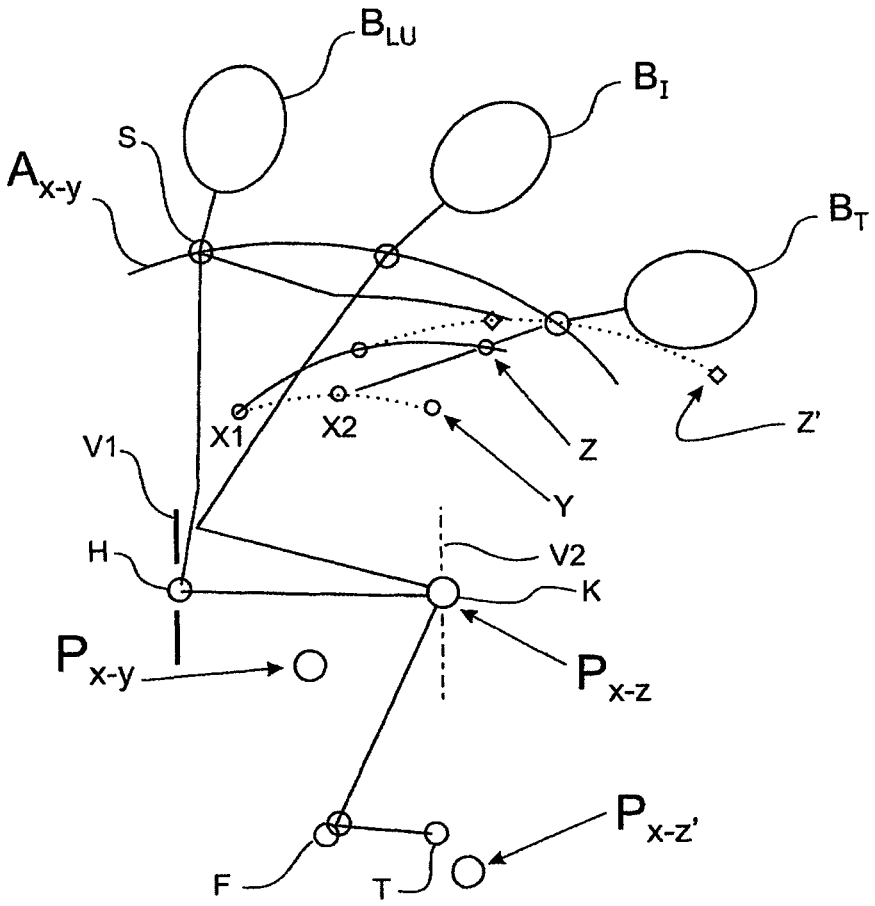
Figure 11:
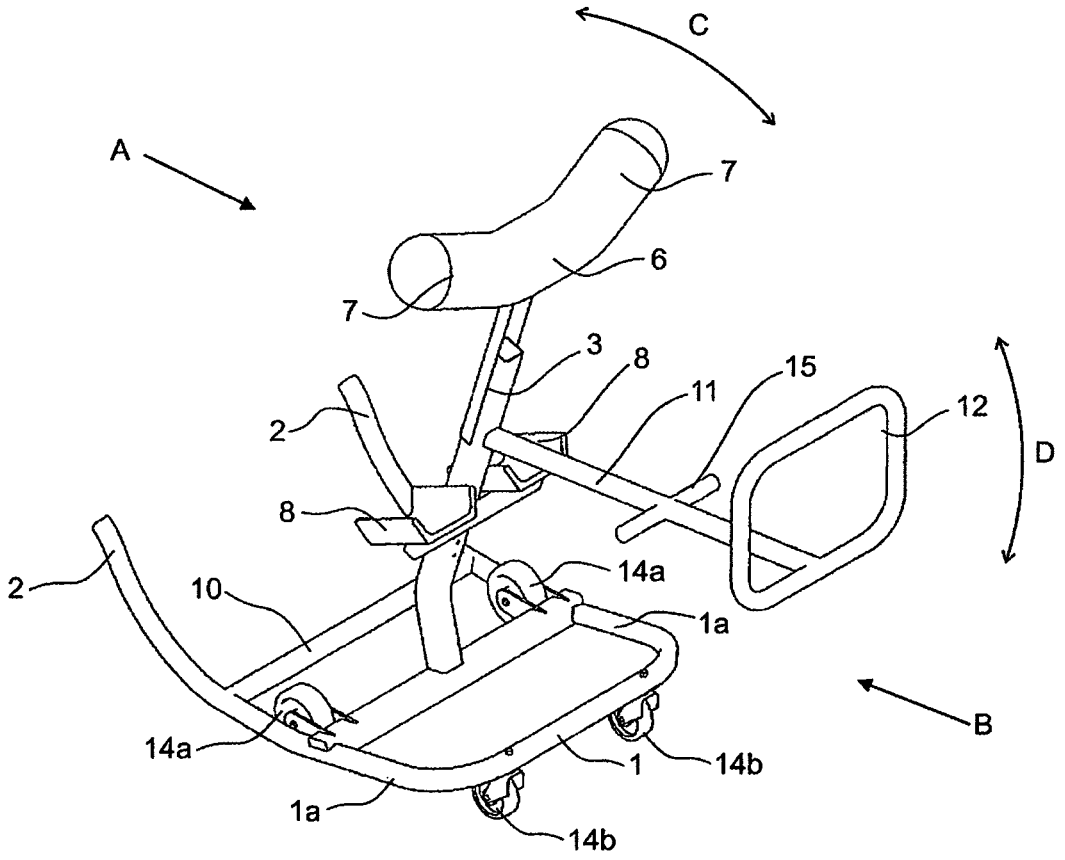
FIGS. 11 to 19 illustrate a second embodiment of patient mover of the invention.
Figure 13:
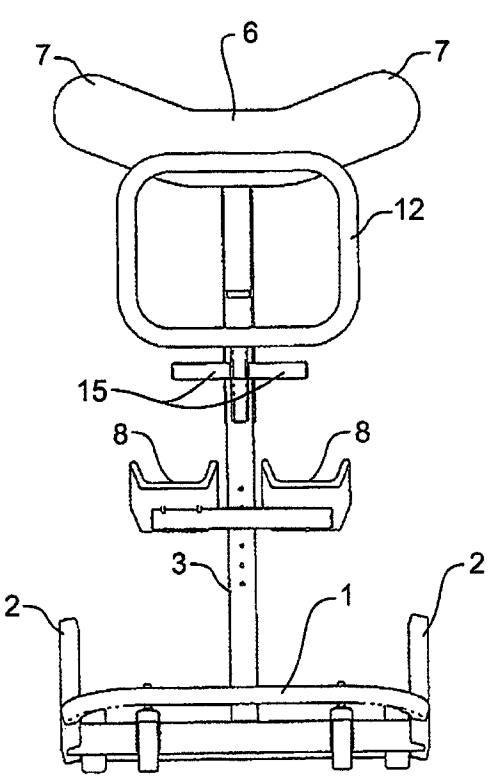
Figure 12:
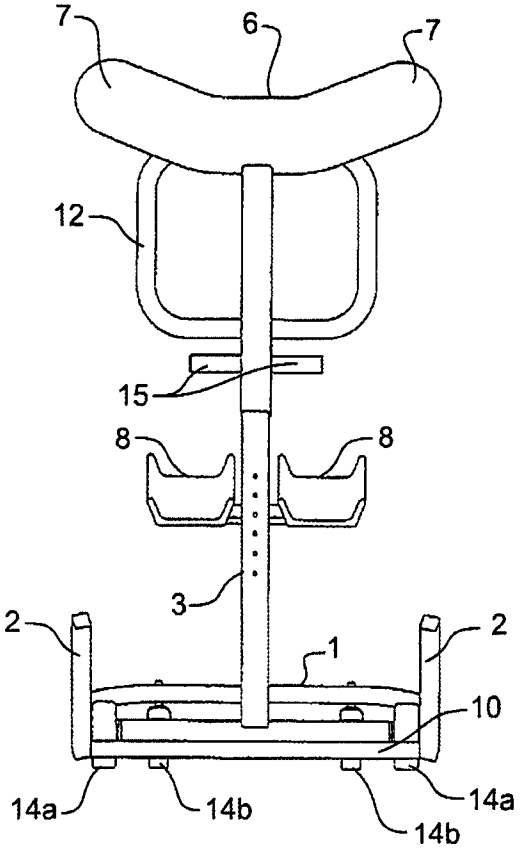
Figure 14:
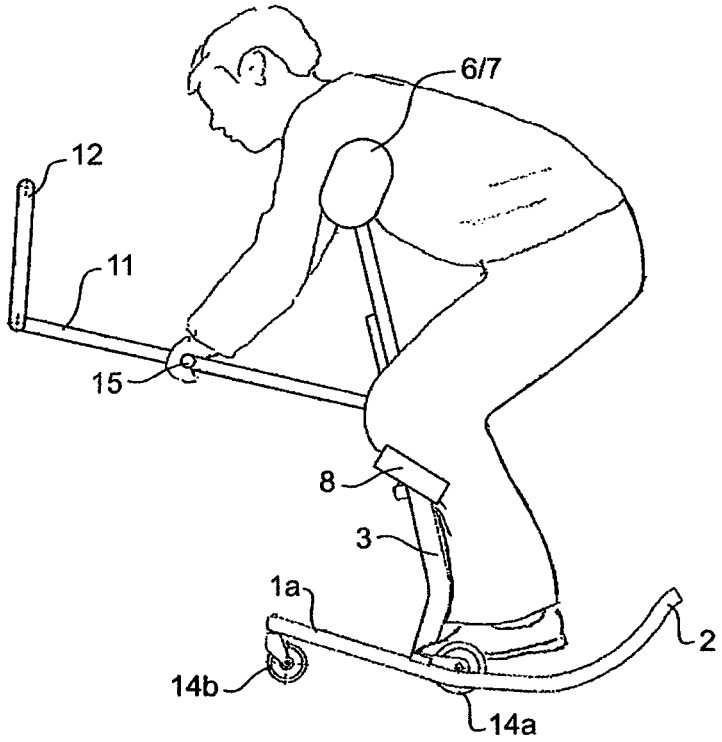
Figure 16:
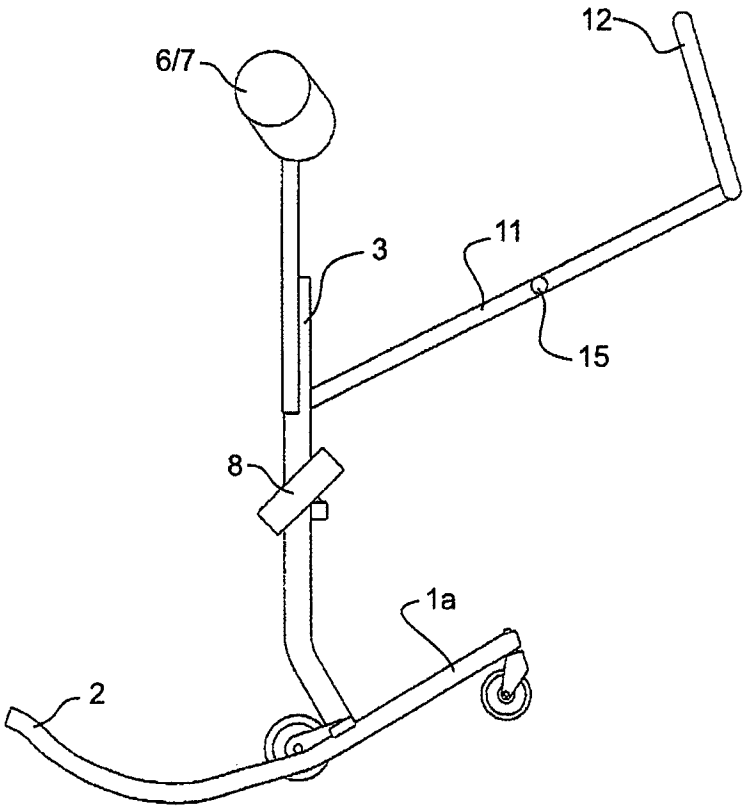
Figure 15:
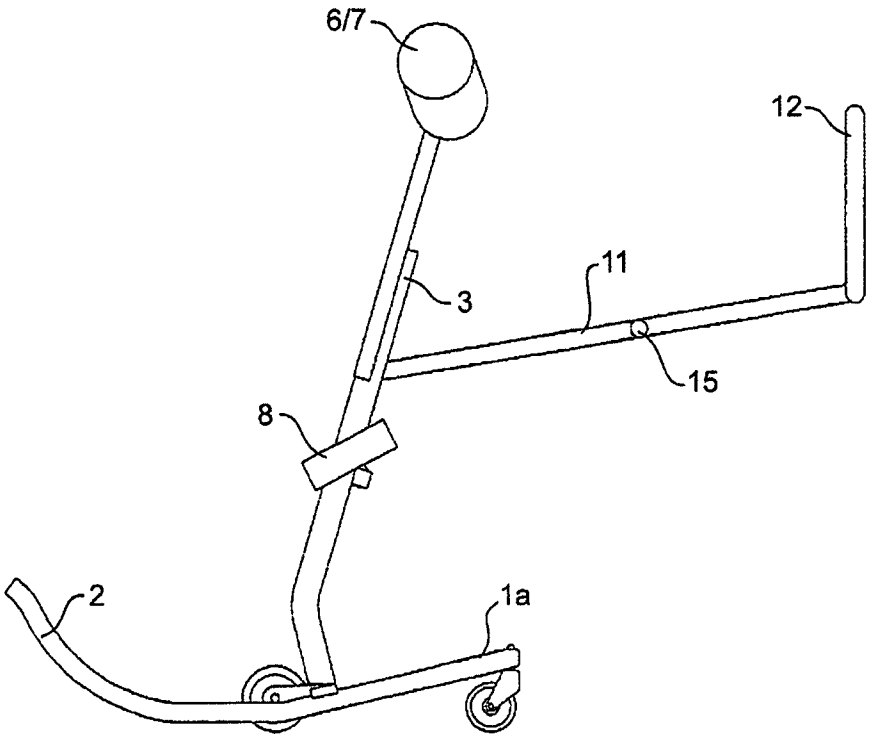

The pivot axis through the pivot points 4 is positioned so that the patient's torso moves substantially about the centre of mass of the patient. This is illustrated in FIG. 10 in which line x1-y indicates the line of movement of the centre of mass of the patient between the load-unload position (patient centre of mass in the unload position indicated at point x1)—and transport position—patient centre of mass in this position indicated at point y. By "centre of mass" in relation to this embodiment is meant the centre of mass of the body of a patient or average patient from the patient's head to the patient's knee joints. Lines x1-z and x1-z' indicate the movement of the centre of mass of a patient on two different prior art patient lifters, and it can be seen that in these there is a significant lifting component to the movement. This in turn requires substantially greater downward force on the operating handle of the prior art devices, from a caregiver who may be a smaller female nurse for example. Because in the patient mover of the invention the pivot axis is positioned so that the patient's torso rolls more than is lifted, less force and thus strength is required of the caregiver. In FIG. 10 points F and T indicate the heels and toes of the patient, which remain on the floor 10 of the patient mover substantially without movement although the patient's heels may rise slightly as the patient is moved from the load-unload to the transport position. The patient's lower legs between the knees and ankles similarly do not move significantly, while the patient's legs bend at the knee joint as the patient's head, torso, and upper legs are substantially rolled about the centre of mass of that part of the patient's body. In FIG. 10 the stick man form of a patient is shown in the load-unload position in which the patient's torso is closer to vertical than horizontal at $B_{LU}$, in an intermediate position at $B_I$, and in the transport position, in which the patient's torso is closer to horizontal than vertical, at $B_T$. It can be seen from FIG. 10 that in addition to the rolling movement referred to, movement of the patient from the load-unload position to the transport position and the reverse may include a component of lifting, or lowering, respectively of the centre of mass of the patient as well as rolling, but if so the lifting and lowering of the patient is relatively small as referred to previously. For example the lifting component of the movement may be not more than 85 mm and more preferably not more than 35 mm in a vertical direction. The pivot axis about which the upper patient carrying part of the patient mover is mounted is indicated at point Px-y in FIG. 10, and it can be seen that it passes through or is parallel with a line across the patient when on the patient mover, intermediate between vertical planes through the knee and hip joints of the patient. Preferably the pivot axis passes through the centre $\frac{1}{3}^{rd}$ of the distance between the vertical plane through the knee joints of the patient, indicated at V2 and K respectively in FIG. 10, and the hip joints, indicated at V1 and H in FIG. 10. As shown, the patient mover is configured in this embodiment such that the top of the patient's sternum (S) is moved through an arc Ax-y which has a center at pivot axis Px-y.

Once the patient has been brought to the transport position as described above (and the upper frame part 3 latched in this position where such a latch is provided) by pulling or pushing on the handle 11/12, the caregiver may wheel the patient mover carrying the patient from one place to another, for example from beside a bed to a chair. To place the patient on the chair the caregiver backs the patient mover up to the chair until the patient's buttocks are positioned above the squab of the chair. The caregiver then allows the handle 11/12 to rise (first unlatching the mechanism as necessary) to thereby lower the patient's buttocks onto the chair. The patient then removes his or her hands from handles 15 and shifts his or her feet from the floor 10, allowing the caregiver to then pull the patient mover away, leaving the patient on the chair. The patient may be moved from the chair for example back to a bed or to a lavatory, by reloading, moving, and unloading the patient in the same way. Because the patient mover of the invention operates to substantially roll the patient about his or her centre of mass, it is easier for a caregiver to manage lowering of the patient onto the chair, as well as lifting the patient as referred to above.

Second Embodiment

FIGS. 11 to 19 illustrate a second embodiment of patient mover of the invention, which again is formed largely of bent metal tube or pipe but may be otherwise constructed. Unless indicated otherwise, similar reference numerals as in FIGS. 1 to 9 indicate similar elements such as cradle 6/7 and handle 11/12 for example.

In this embodiment a lower floor engaging frame part 1 again has an approximate square u-shape as shown and mounts a central upright 3. Referring particularly to those figures which show the patient mover of this embodiment in side elevation, a section 1*a* of the lower frame part on either side is formed with a low radius of curvature in a vertical plane (or no radius of curvature so that section 1*a* is flat or substantially flat) and sections 2 on the patient side of the device are formed with a decreased radius of curvature or at least are cranked away from the sections 1*a* as shown. Rollers 14*a* (or skids) are provided which protrude slightly below the frame 1 and wheels 14*b* are provided at or towards the opposite end of each side of the lower frame part 1 to the sections 2. The central upright 3 mounts a padded cradle 6 with arms 7. Bar 10 performs a similar function to the floor 10 in the first embodiment, and lower leg contacting parts 8 are also provided on either side of the frame of the device as shown.

Figure 18:
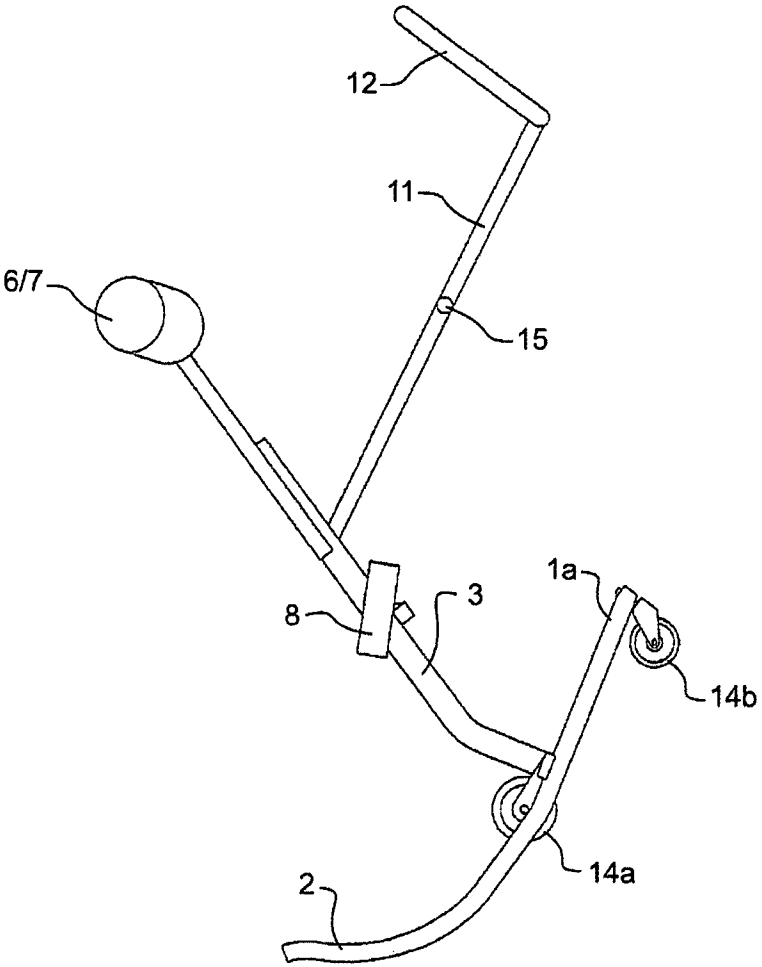
Figure 17:
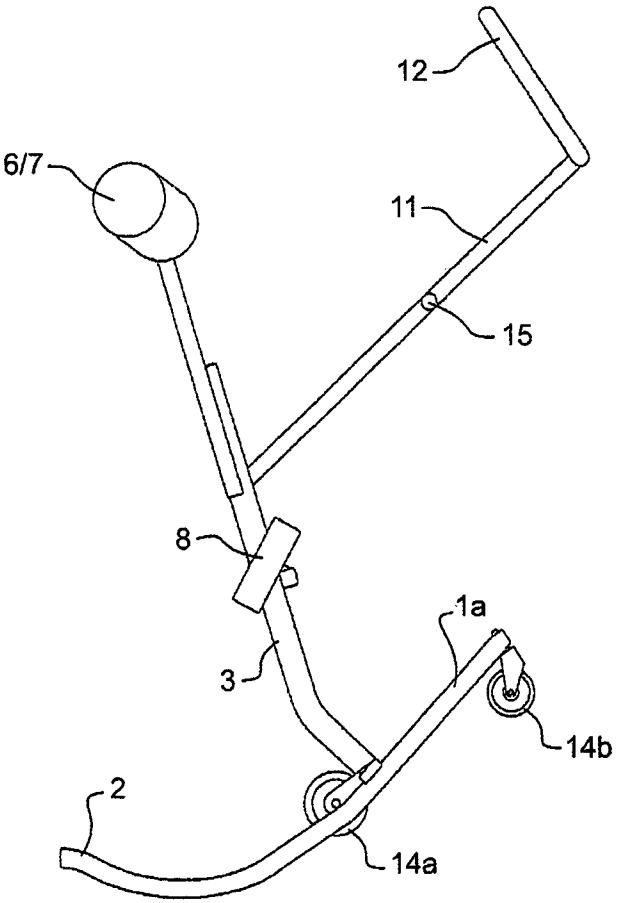

In use the patient mover in the transport position i.e. with both wheel pairs 14*a* and 14*b* on the ground, is brought up to a seated patient and the patient is asked to place his or her feet on the bar 10, and the handle 11/12 is raised thus tilting the mover up on to the outer ends of the curved sections 2 into the load position shown in FIG. 18. The patient is asked to lean forward until the patient's chest contacts the cradle 6/7, and lift his or her arms over the cradle 6/7 to grasp or rest the hands on handle 15. The patient's lower legs are supported by the parts 8. The caregiver then pushes the handle 11/12 downwardly, as indicated by arrow D in some figures, to roll the device on the curved sections 2 from the load-unload position shown in FIG. 18, as indicated by arrow C, through the first and second intermediate positions shown in FIGS. 16 and 17, and to the transport position shown in FIGS. 11 to 15. This elevates the patient's buttocks relative to the load-unload position, by a rolling movement of the patient about a virtual axis or line across the device, more so than by lifting in a vertical direction. The centre of mass of the patient remains at substantially the same height. By "centre of mass" in relation to this embodiment is meant the centre of mass of the body of a patient or average patient from the patient's head to the patient's feet.

Figure 19:
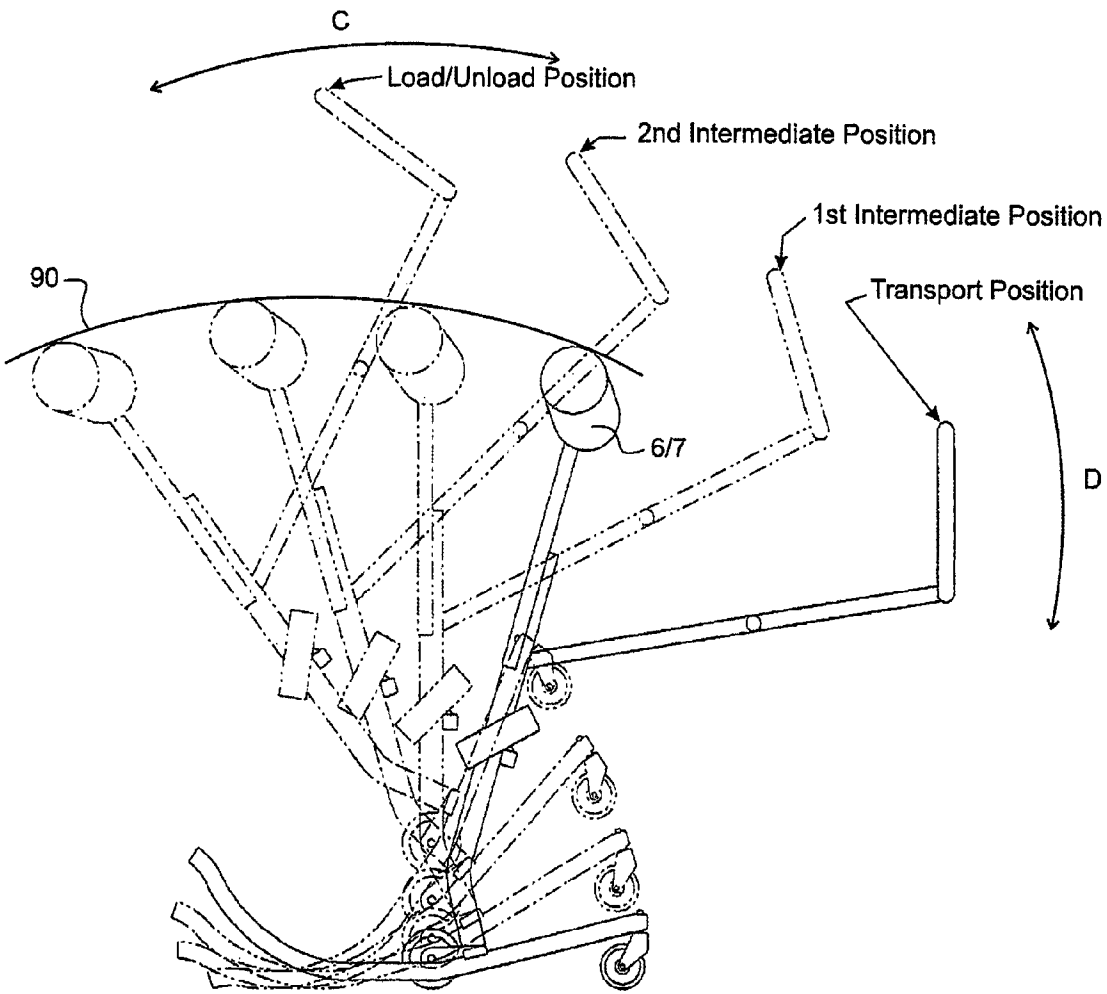
Figure 20:
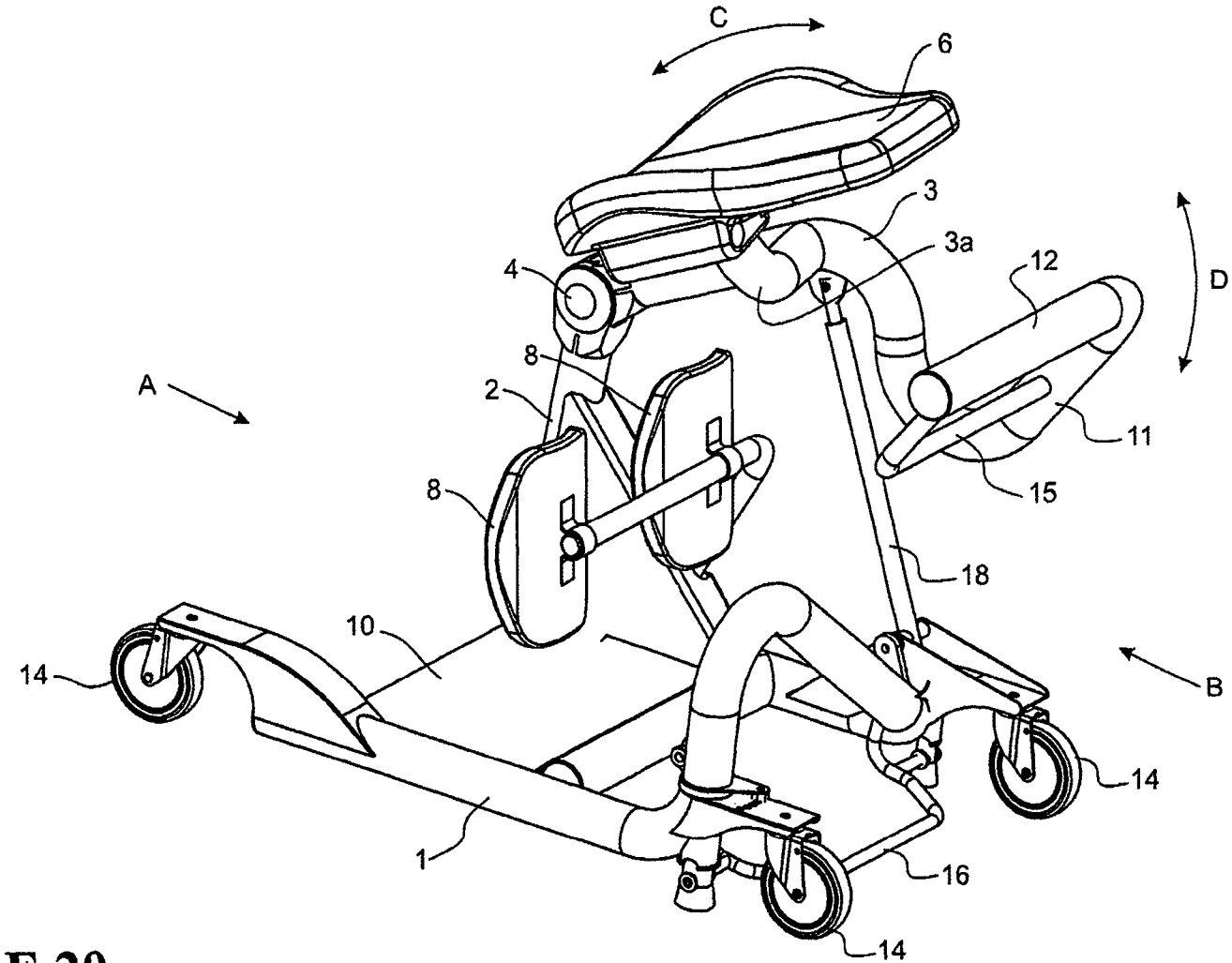
Figure 24:
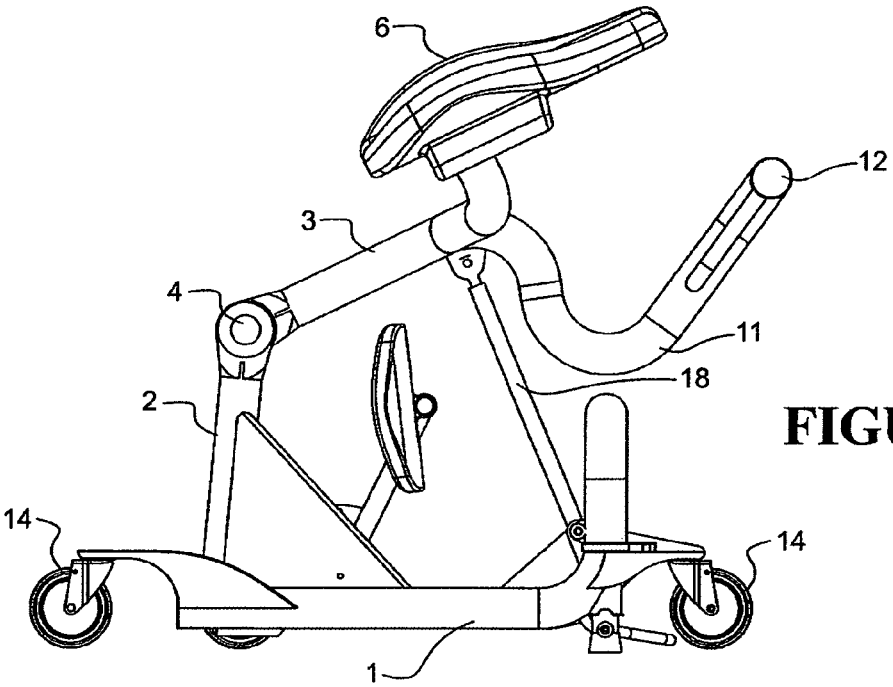
Figure 25:
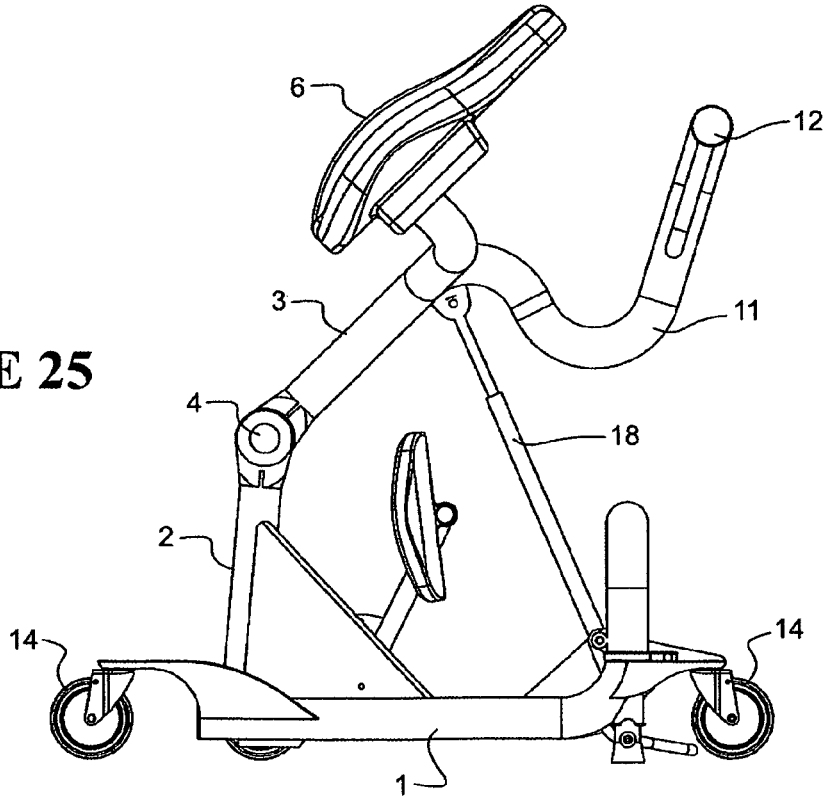
Figure 26:
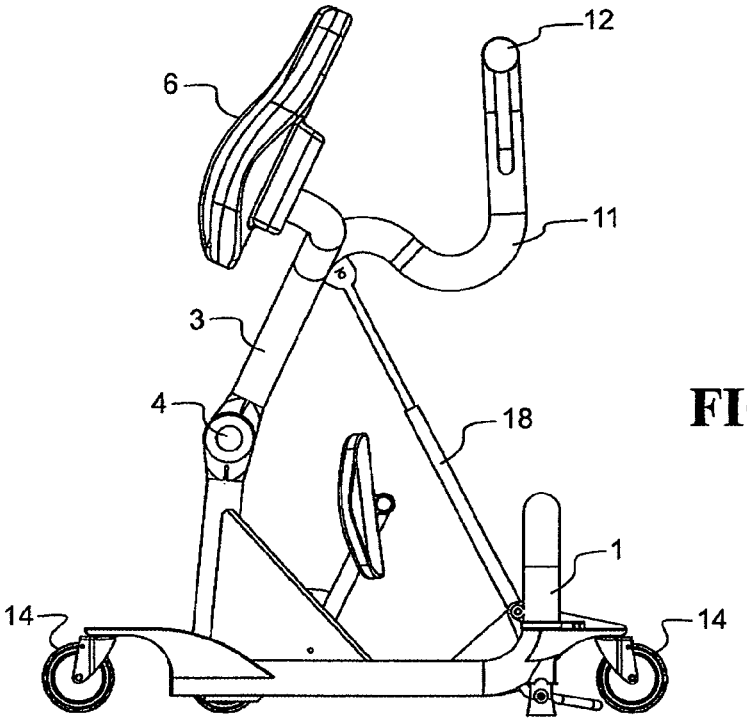
Figure 27:
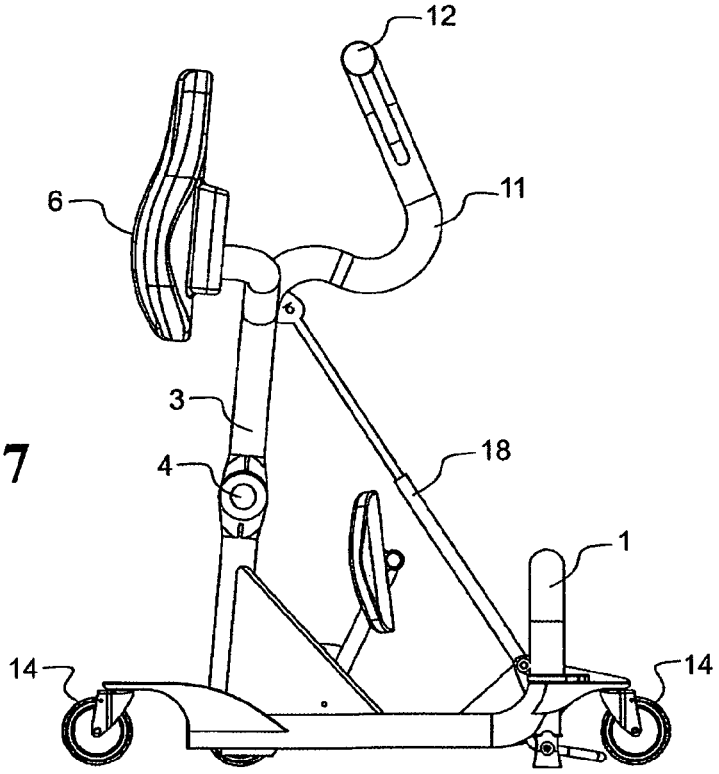

With refer to FIG. 19, the movement of the patient mover between the load-unload position and transport position causes the cradle 6/7 to move through an arc about a centre or virtual axis. In the preferred form, the arc of movement is defined as the path through which the point on the cradle that abuts the top of the patient's sternum moves as the device moves between its load-unload and transport positions and is generally indicated at 90 by way of example. In the preferred form, the virtual axis (not shown) or center of the arc passes through or is parallel with a line across the patient when the patient is seated in the load-unload position, intermediate between two vertical planes coincident with the knee and hip joints of the patient. Like with the first embodiment, preferably the virtual axis passes through the centre $\frac{1}{3}^{rd}$ of the distance between the two vertical planes coincident with the knee and hip joints of the patient.

As can be seen from the drawings, when the patient mover is in the load position the sections 2 of the lower frame on either side contact the ground so that the wheels 14*a* and 14*b* are lifted from the ground, so that the device is relatively immoveable while a patient is loaded onto or unloaded from the device, and the wheels do not contact the ground again until the caregiver lowers the device carrying the patient to the transport position.

As before, once in the transport position the patient mover carrying the patient may be moved by the operator pulling or pushing the patient mover and patient to another location, at which point the operator may lift the handle 11/12 to move the patient mover and patient from the transport to the load-unload position to deposit the patient on a chair or similar.

Third Embodiment

FIGS. 20-27 illustrate a third embodiment of patient mover of the invention which is similar to that of FIGS. 1-9. Unless indicated otherwise again similar reference numerals as in FIGS. 1-9 indicate similar elements. In this embodiment the lower floor engaging frame part 1 comprises a single upright element 2 on one side, and the upper frame part comprises a single part 3 on the same side and pivotally mounted by (single) pivot 4 to the top of the single upright element 2.

The upper and lower frame parts are formed of relatively large diameter tube for strength. The upper frame part includes transverse part 3*a* to which the cradle 6 is mounted. Telescopic stabilising strut 18 which may also provide limit stops for movement between the load-unload and transport positions is provided on the one side only of the device. As before the device may also include a latch mechanism which is engaged when the upper frame part 3 is returned to the transport position, to lock the upper frame 3 in the transport position until it is unlatched deliberately by the caregiver, and again the latch mechanism may be associated with the telescopic strut 18 and may be released to enable the upper frame part to be moved from the transport position, by a pull associated with the handle 12 and connected to the latch via a cable passing within the tubular upper frame part 3; or it may be associated with the braking pedal 16. Otherwise, the third embodiment patient mover is configured and operates in a substantially similar manner to the first embodiment patient mover.

Fourth Embodiment

Figure 29:
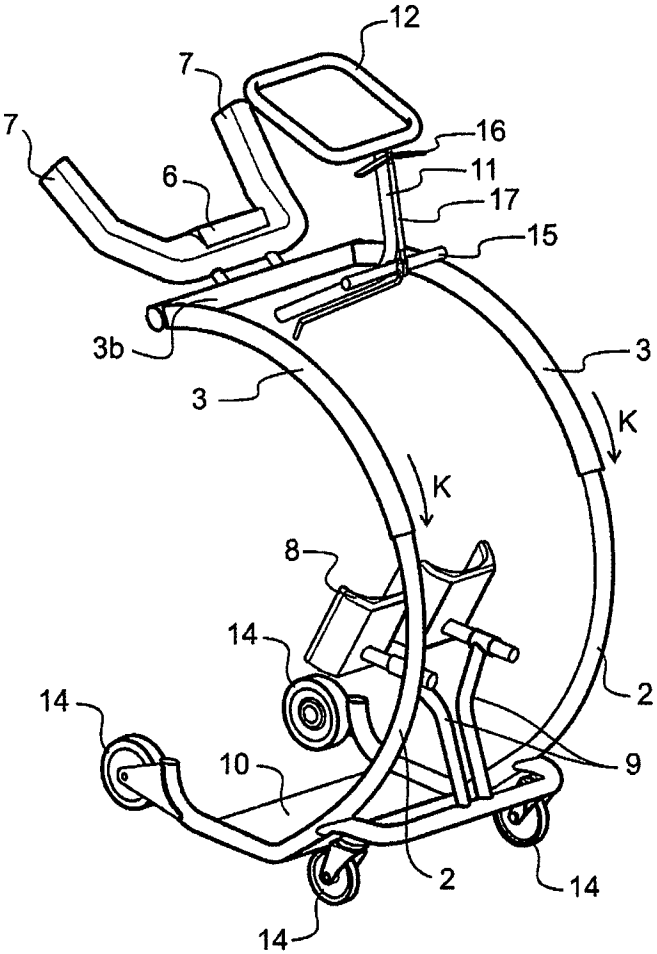
FIGS. 28 and 29 illustrate a fourth embodiment of patient mover of the invention.
Figure 28:
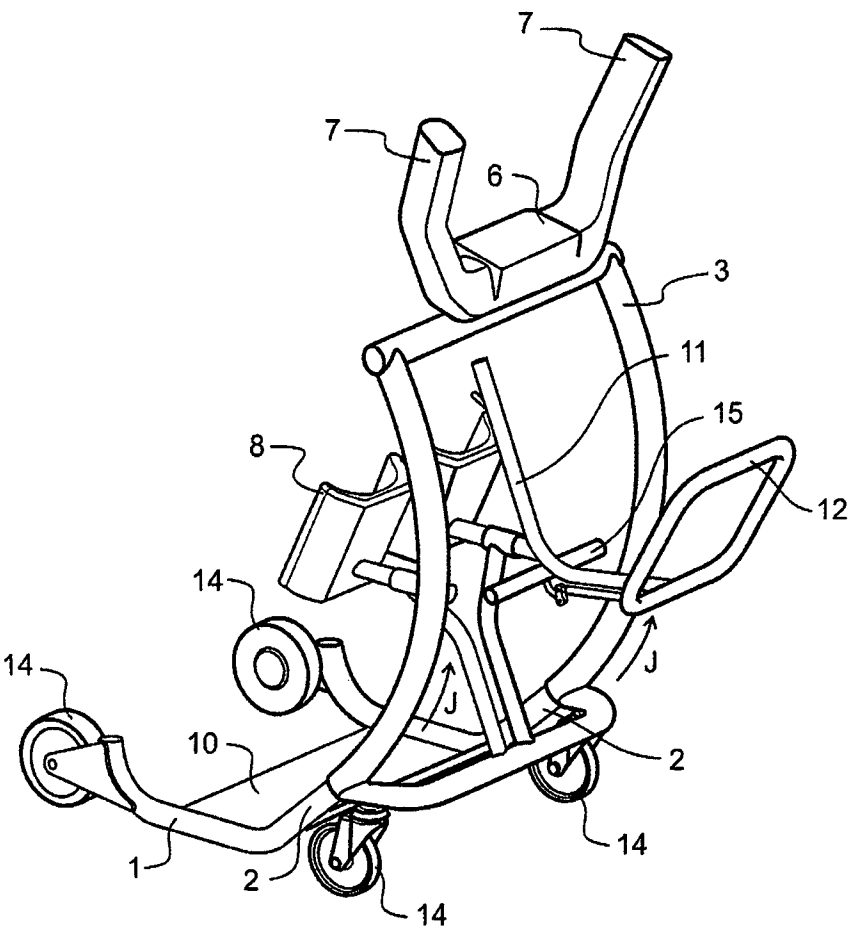

FIGS. 28 and 29 illustrate a fourth embodiment patient mover of the invention. Both figures are a perspective view from the carer's viewpoint, and FIG. 28 shows the patient mover in the transport position and FIG. 29 shows the patient mover in the load-unload position. Again the patient mover is formed largely of bent metal tube or pipe, but may be otherwise constructed. Unless indicated otherwise similar reference numerals as before indicate similar elements. In this embodiment the upper frame part 3 is telescopically mounted to the lower frame part 1, so that the upper frame part may move telescopically relative to the lower frame part between the transport and load-unload positions. Specifically, the upright elements 2 of the lower frame part are curved as shown, and the upper frame part comprises larger (internal) diameter and correspondingly curved parts 3 connected by cross part 3*b*, each of which is telescopically mounted on one of the respective elements 2 of the lower frame part. The cradle 6/7 (or upper patient carrying part) is fixed or mounted centrally to the cross part 3*b* of the upper frame part 3. The upper frame part may be raised and moved telescopically from the transport position shown in FIG. 28, in the direction of arrows J in FIG. 28, to the load-unload position of FIG. 29, and lowered from the load-unload position in the direction of arrows K in FIG. 29 back to the transport position. The telescopic movement of the upper frame part on the lower frame part follows a curvilinear path. In the preferred form, the curvilinear path follows an arc about a virtual axis extending across the device. Preferably, like embodiment 2, the patient mover is configured such that the arc is defined as the path of movement of the point on the cradle 6/7 that abuts the top of the patient's sternum and the virtual axis of the arc preferably passes through or is parallel with a line across the patient when the patient, is in the load-unload position intermediate between two vertical planes coincident with the knee and hip joints of the patient. In a preferred form, the virtual axis passes through the centre $1/3^{rd}$ of the distance between the two vertical planes coincident with the knee and hip joints of the patient.

In an alternative arrangement instead of the upper frame part 3 being telescopically mounted to the lower frame part 2, the two may be connected slidingly for such curvilinear movement between the transport and load-unload positions, for example. An example of a sliding arrangement will be explained with reference to the fifth embodiment below.

Fifth Embodiment

FIGS. 30-38 illustrate a fifth embodiment patient mover of the invention which is similar to the fourth embodiment of FIGS. 28 and 29. Unless indicated otherwise, similar reference numerals indicate the same or equivalent elements. In this embodiment, the cradle 6 is in the form of a chest pad that is shaped for engaging with the patient's chest, and it will be appreciated that other suitable forms of upper patient carrier parts could be used for engaging with the patient's torso in alternative embodiments.

In this embodiment, the lower floor engaging frame part 1 comprises two spaced apart elongate elements 21*a*,21*b*. The elongate elements 21*a*,21*b* extend between respective first ends located on the patient side of the patient mover and respective second ends located on the carer side of the patient mover. The elongate elements 21*a*,21*b* are coupled together by a cross member 22 fixed to and extending between the elements at or towards their second ends on the carer side of the patient mover. In this embodiment, the elongate elements 21*a*,21*b* are fixed in a non-parallel orientation with respect to each other. In a preferred form, the elongate elements 21*a*,21*b* are orientated such that their second ends are closer together on the carer side of the patient mover compared to their first ends on the patient side, which are spaced further apart. This arrangement provides a wide access space through which the patient mover can engage with a seated patient on the patient side.

As with some of the previous embodiments, a front pair of swivelable wheels 14 are provided on the carer side of the patient mover and which extend from or are mounted to the first ends of the elongate elements 21*a*,21*b* of the lower frame part 1. Additionally, a rear pair of wheels 14 are provided on the patient side of the patient mover and which extend from or are mounted to the second ends of the elongate elements 21*a*,21*b*. In the preferred form, the rear pair of wheels may be fixed in orientation such that they are non-swivelable. It will be appreciated that either or both of the front and rear pairs of wheels are replaced with rollers, skids or slides in alternative embodiments. Further, lower frame part 1 need not necessarily include wheels or equivalents in embodiments of the patient mover that are intended to enable the patient to be raised and lowered without movement from place to place.

The lower frame part 1 further comprises an upright element 2 that extends substantially vertically up from cross member 22 and which is preferably centrally located between the elongate elements 21*a*, 21*b*. A floor or floor panel 10 is provided at or toward the lower end of the upright element 2 in the vicinity of the cross member 22 and is mounted to upright element 2 so as to extend toward the patient side of the patient mover. The floor panel 10 is provided with left and right feet supporting surfaces on either side of the upright element 2 upon which the patient may place their feet. In the preferred form, a padded lower leg contacting panel 8 is provided on the patient side of the patient mover and is mounted to the upright element 2 by coupling elements 23*a*, 23*b* extending from the upright element between its upper and lower ends and preferably toward its upper end. In this embodiment, the lower leg engaging panel 8 is provided with left and right lower leg support surfaces that are provided on either side of the upright element 2 for contacting and supporting the lower legs of the patient on the device. As with previous embodiments the lower leg contacting panel is preferably padded and is adjustably mounted in position relative to element 2 in the direction of arrow E toward or away from the patient.

In this embodiment, the upper frame part 3 is slidably mounted to the lower frame part 1, so that the upper frame part may move slideably relative to the lower frame part between the transport and load-unload positions. In the preferred form and with reference to FIGS. 30 and 33 particularly, the upper frame part 3 is in the form of a curved elongate member extending between a lower end 25*a* and an upper end 25*b*. The curved member 3 is operatively coupled to the upright element 2 of the lower frame part 1 for slideable movement via one or more mounting or guide components that form a curvilinear guide path having extending upwardly from the lower frame part. In this embodiment, the curved member 3 is operatively coupled to a lower mounting component 26 extending from and located at or toward a lower end of upright element 2 and an upper mounting component 27 extending from and located at or toward an upper end of the upright element 2. Upper and lower mounting components 26,27 are configured to act as guides through which curved member 3 may slide or travel in a curvilinear path as indicated by arrow F so as to cause the cradle 6 it carries to also move in a corresponding curvilinear path between the load-unload and transport positions as shown by arrow C as the carer operates the handle 12 in the direction shown by arrow D.

Figure 30:
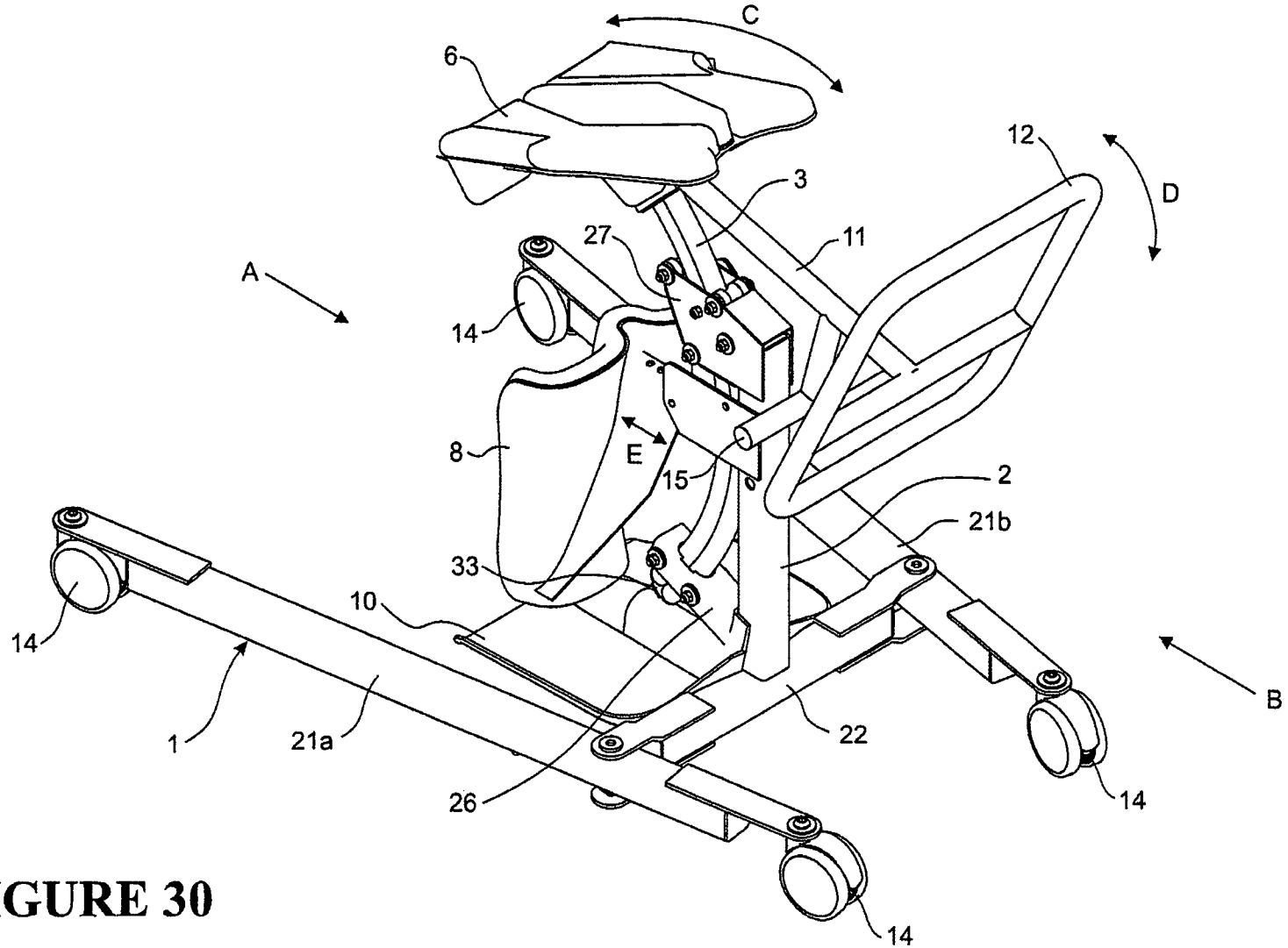
FIGS. 30-38 illustrate a fifth embodiment of the patient mover of the invention.
Figure 32:
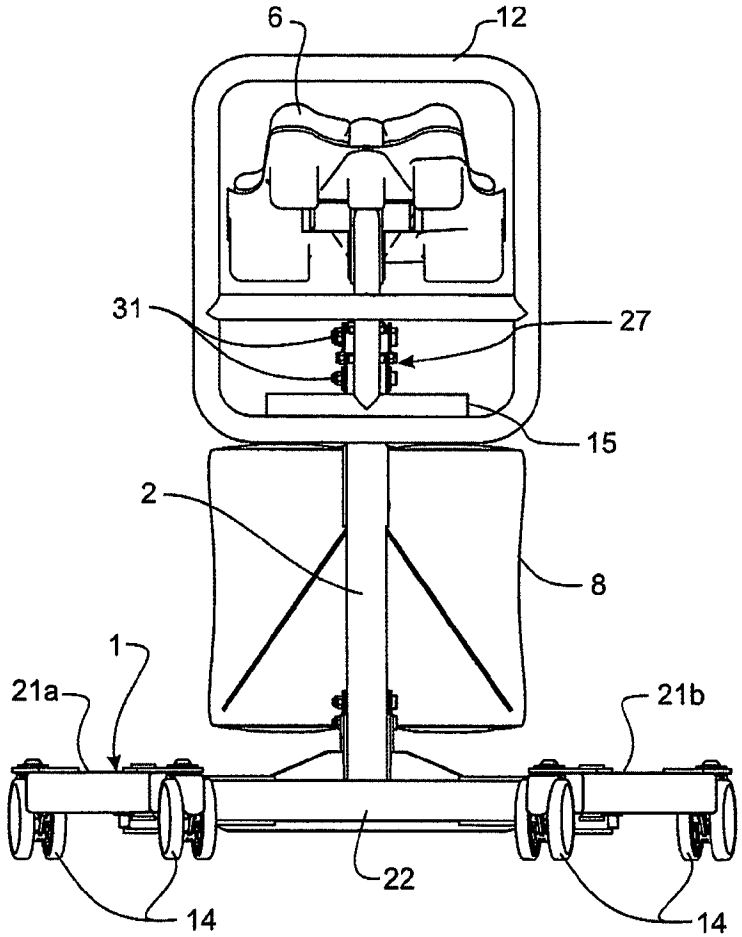
Figure 31:
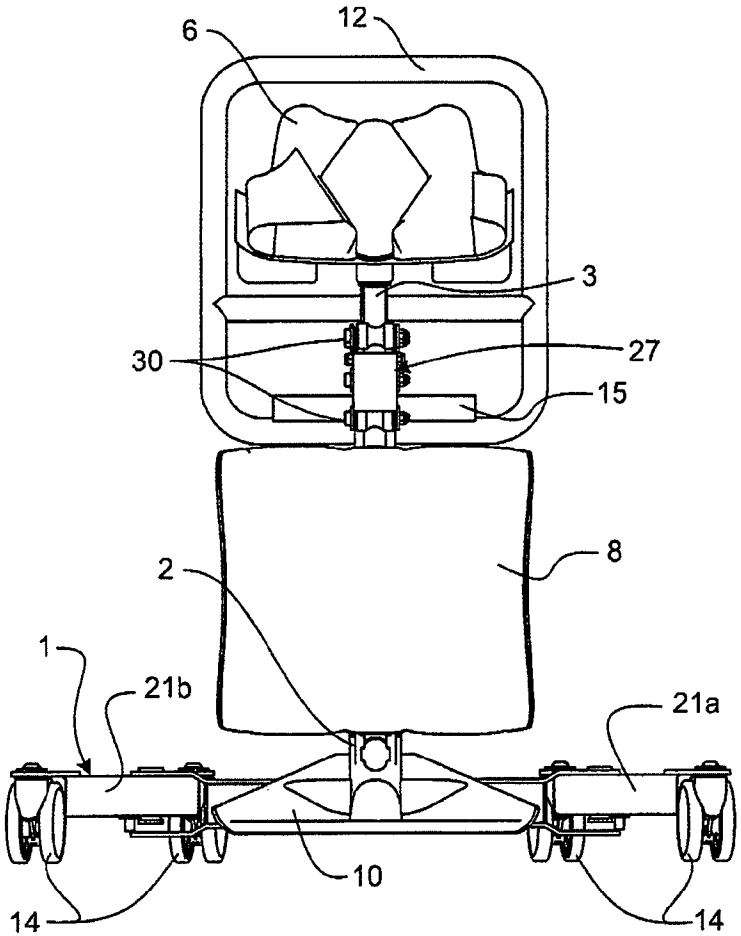
Figure 33:
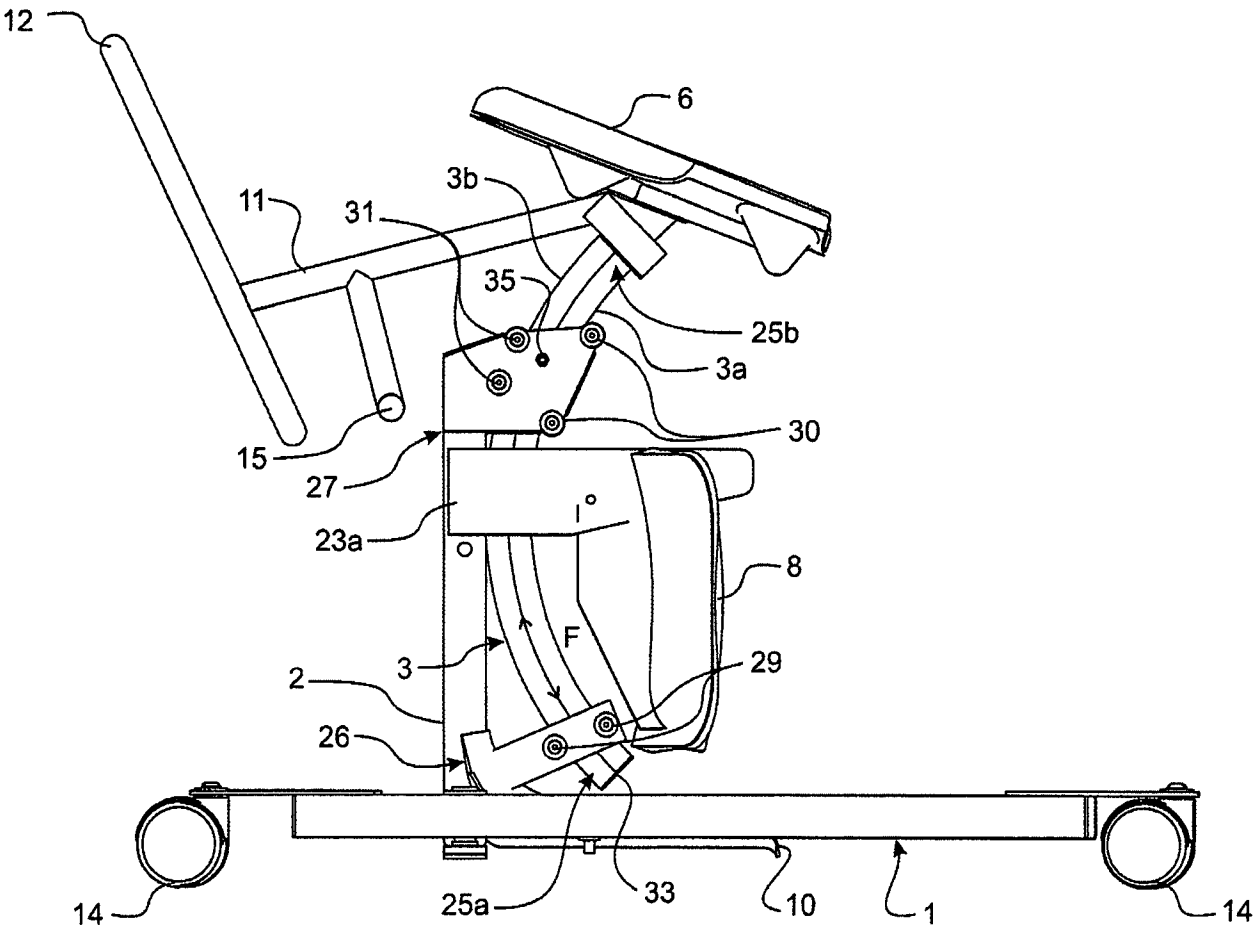
Figure 34:
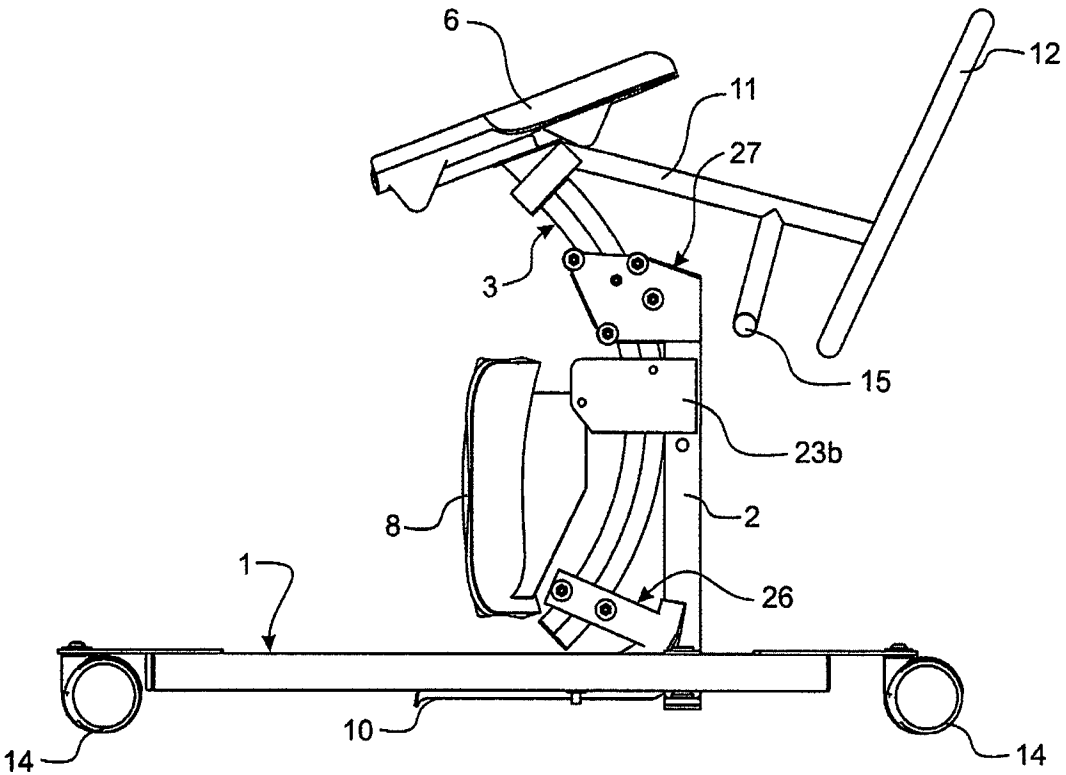

In the preferred form show and with reference to FIG. 30, each mounting component 26,27 is adapted to provide a guide aperture through which the curved member 3 extends or travels as it is being moved between the transport and load-unload positions. To assist the slideable movement of the curved member 3 through or relative to the guide apertures of the mounting components 26,27, one or more bearings are provided in each of the mounting components and these are located in the vicinity of the guide apertures so as to contact or abut either or both of the inner surface 3*a* or side of the curved member 3 of the patient side of the patient mover and the outer surface 3*b* or side of the curved member 3 on the carer side of the patient mover as shown in FIG. 33. By way of example, the lower mounting component 26 is provided with a pair of bearings 29, each of which is arranged to abut respective opposite sides 3*a*, 3*b* of the curved member 3. The upper mounting component 27 comprises two spaced apart bearings 30 that are arranged to contact the inner side 3*a* of the curved member 3 and two spaced apart bearing 31 located so as to contact the opposite outer side 3*b* of the curved member 3. In this embodiment, the bearings 29,30,31 are all in the form of rotatable rollers that are rotatably mounted within or to their respective mounting components 26,27 for rolling engagement with the curved member. As will be appreciated, the bearings rotate about their respective axes as the curved member 3 moves between the load-unload and transport positions in the curvilinear path such that bearings act as sandwiching guide rollers that rotatably engage opposite sides of the curved member and through which the curved member travels back and forth. It alternative embodiments, the some or all of the bearings may be in the form of bearing surfaces that allow for slidable movement of the curved member 2 through the mounting components. 26,27 or any other sliding arrangement or configuration.

Figure 35:
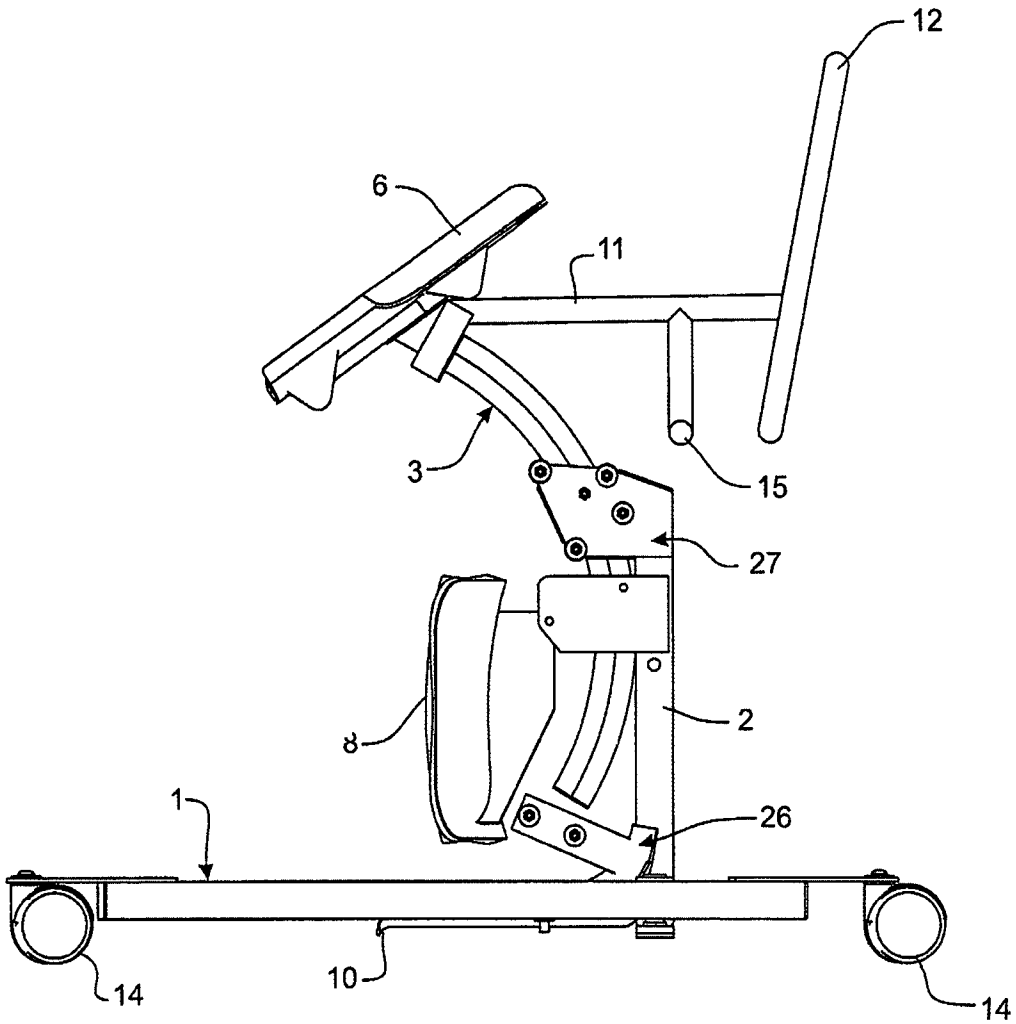
Figure 36:
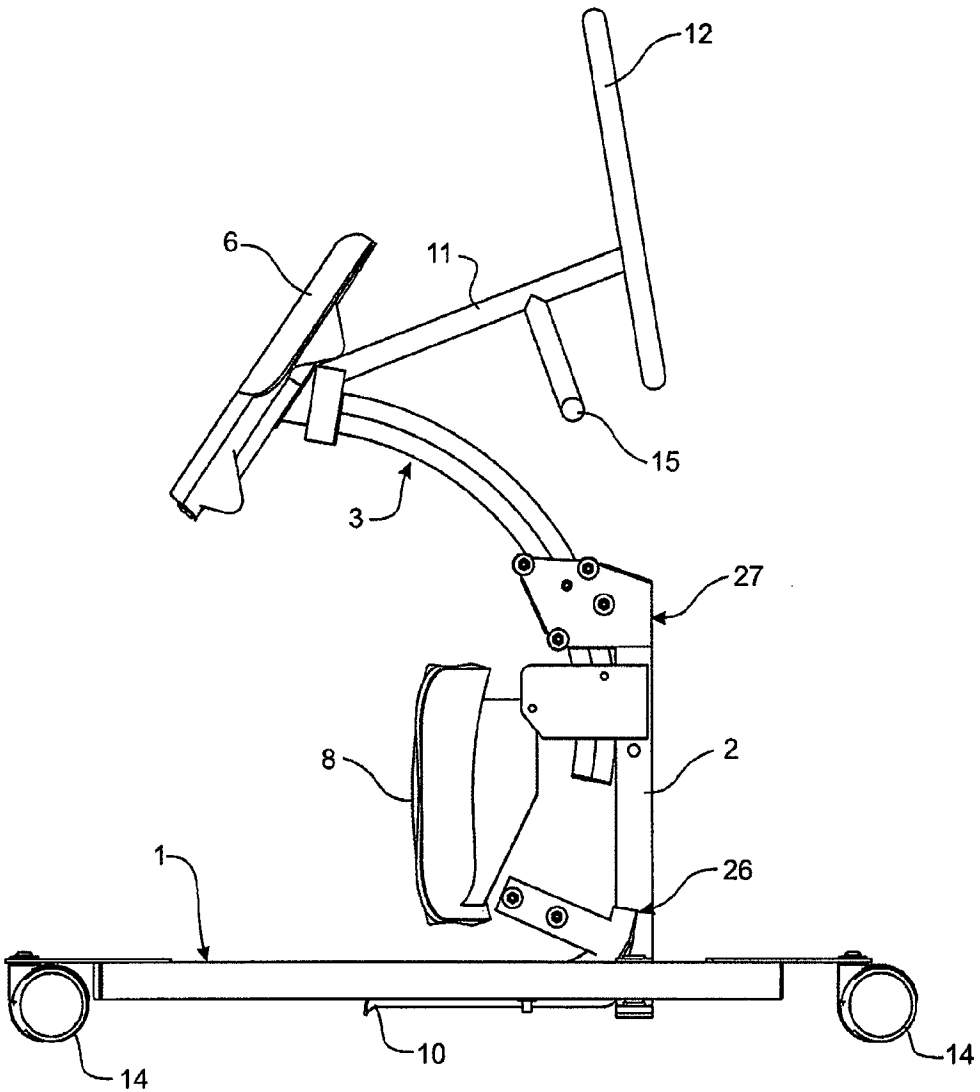
Figure 37:
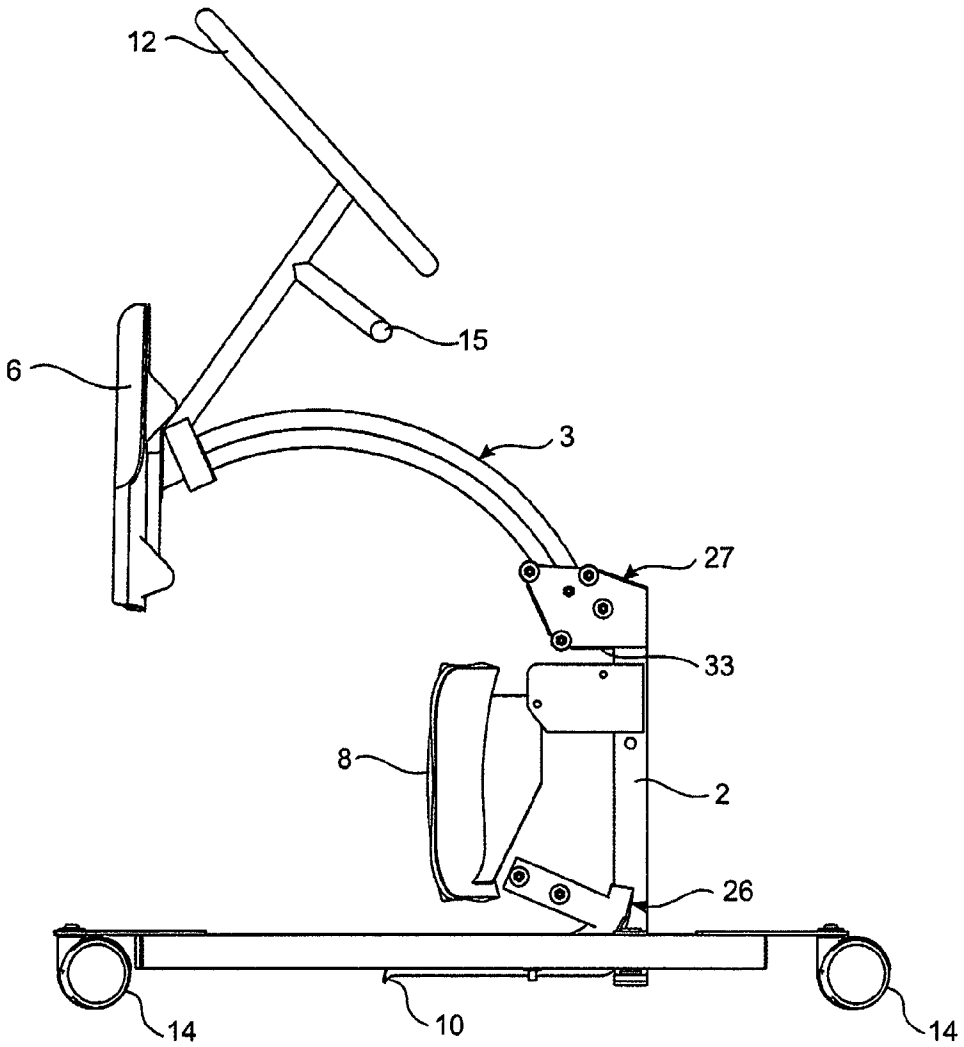

As shown in FIGS. 35-37, in which the patient mover is shown in the first intermediate, second intermediate, and load-unload positions, the lower end 25*a* of the curved member 3 is free to slide entirely through and away from the lower mounting component 26. However, the upper mounting component 27 is configured so as to restrict the lower ended 25*a* from travelling entirely through its guide aperture to prevent the upper frame part 3 from completely releasing from the lower frame part 1 in use. More specifically, in this preferred embodiment a stop component 33 is provided at a lower end 25 of the curved member 3 that is arranged to engage or contact with a corresponding stop element or surface provided on or in the upper mounting component 27 as the curved member 3 travels to the full load-unload position. It will be appreciated that the curved member 3 may be provided with one or more stop components along its length, and typically at or toward its upper and lower ends, for engaging with surfaces or components of the lower frame part 1 or some other stopping mechanism to limit the slidable travel path of the curved member to between the load-unload and transport positions.

In the preferred embodiment, an operable latching mechanism may be provided on the patent mover for locking the upper frame part 3 relative to the lower frame part 1 in any desired position or positions along the travel path. By way of example, the upper mounting component 27 may be provided with an operable locking bolt 35 that is operable to extend through a complementary aperture or apertures provided through and along the curved member 3 so as to lock it in place in one or more positions. In some embodiments, the latching mechanism may be operable to lock the upper frame part into the transport position until it is unlatched deliberately by the carer.

With reference to FIG. 30, as in the other embodiments, an arm 11 extends from the upper end 25*b* of the curved part 3 of the upper frame part on the carer side of patient mover and terminates in a handle 12 which may be raised or lowered in the direction of arrow D to slide the upper frame part 3 between the load-unload and transport positions. A handle or handles 15 for the patient to grip is also provided and extend from the arm 11. The upper frame part 3 further includes a cradle or pad 6 that is shaped and configured for engaging with and supporting a patient's torso as previously described with reference to the other embodiments.

Figure 38:
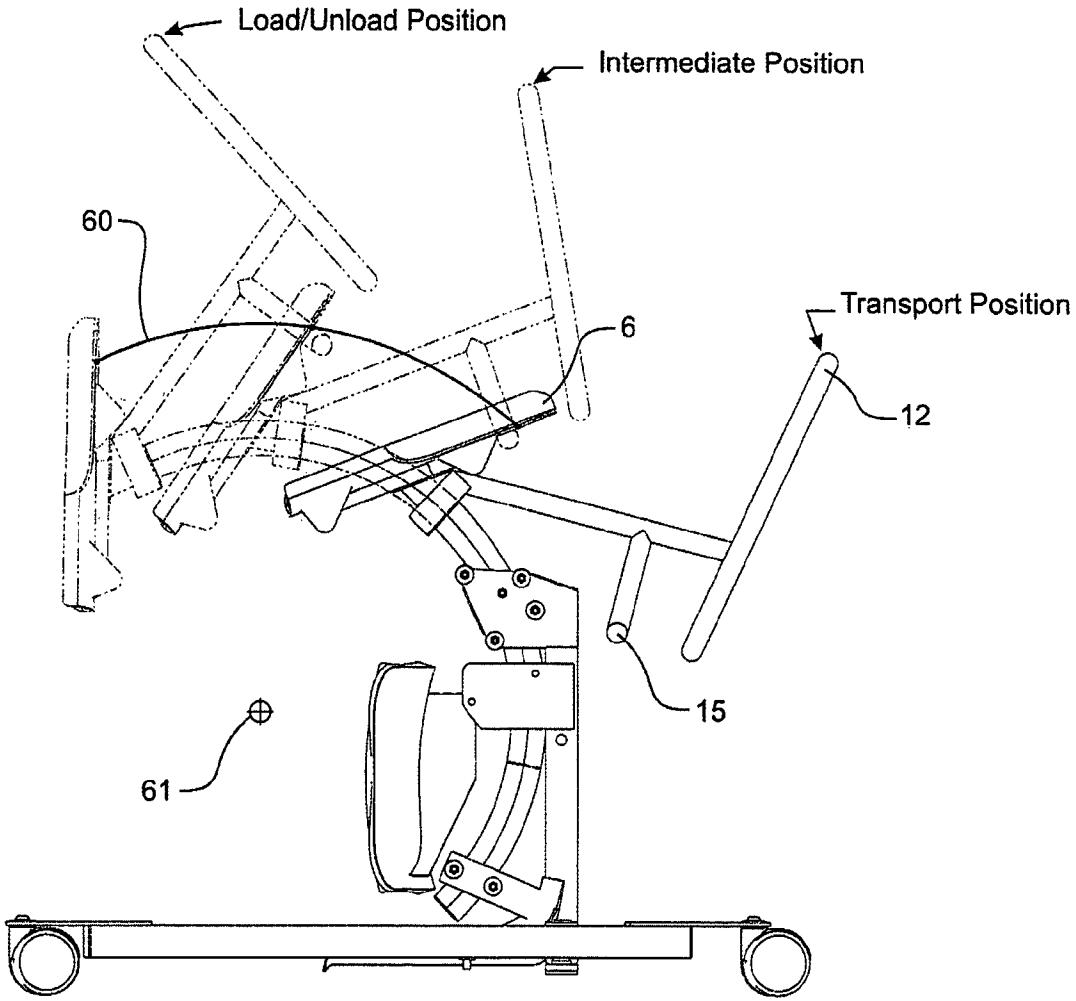

As with the fourth embodiment patient mover, the fifth embodiment patient mover is configured such that the upper frame part is slideably moveable relative to the lower frame part 1 in a curvilinear path. In the preferred form, the curvilinear path is in the form of an arc that is centered about a virtual axis that passes through or is parallel with a line across the patient when the patient in the load-unload position, intermediate between two vertical planes coincident with the knee and hip joints of the patient. In the preferred form, the arc 60 is defined by the path through which the point on the cradle 6 that abuts the top of the patient's sternum travels and preferably the virtual axis 61 of this arc passes through the central $1/3^{rd}$ of the distance between the two vertical planes of the knee and hip joints of the patient as generally shown in FIG. 38.

Sixth Embodiment

FIGS. 39-47 illustrate a sixth embodiment patient mover of the invention. The sixth embodiment patient mover is constructed in a similar manner to the fifth embodiment in relation to the lower frame part 1 and other features and similar references are used to indicate similar or equivalent elements. The primary difference between the sixth embodiment patient mover and the fifth embodiment is the nature of the operative coupling between the lower frame part 1 and the upper frame part 3 that facilitates the movement of the device between the transport and load-unload positions as explained in the previous embodiments.

Figure 39:
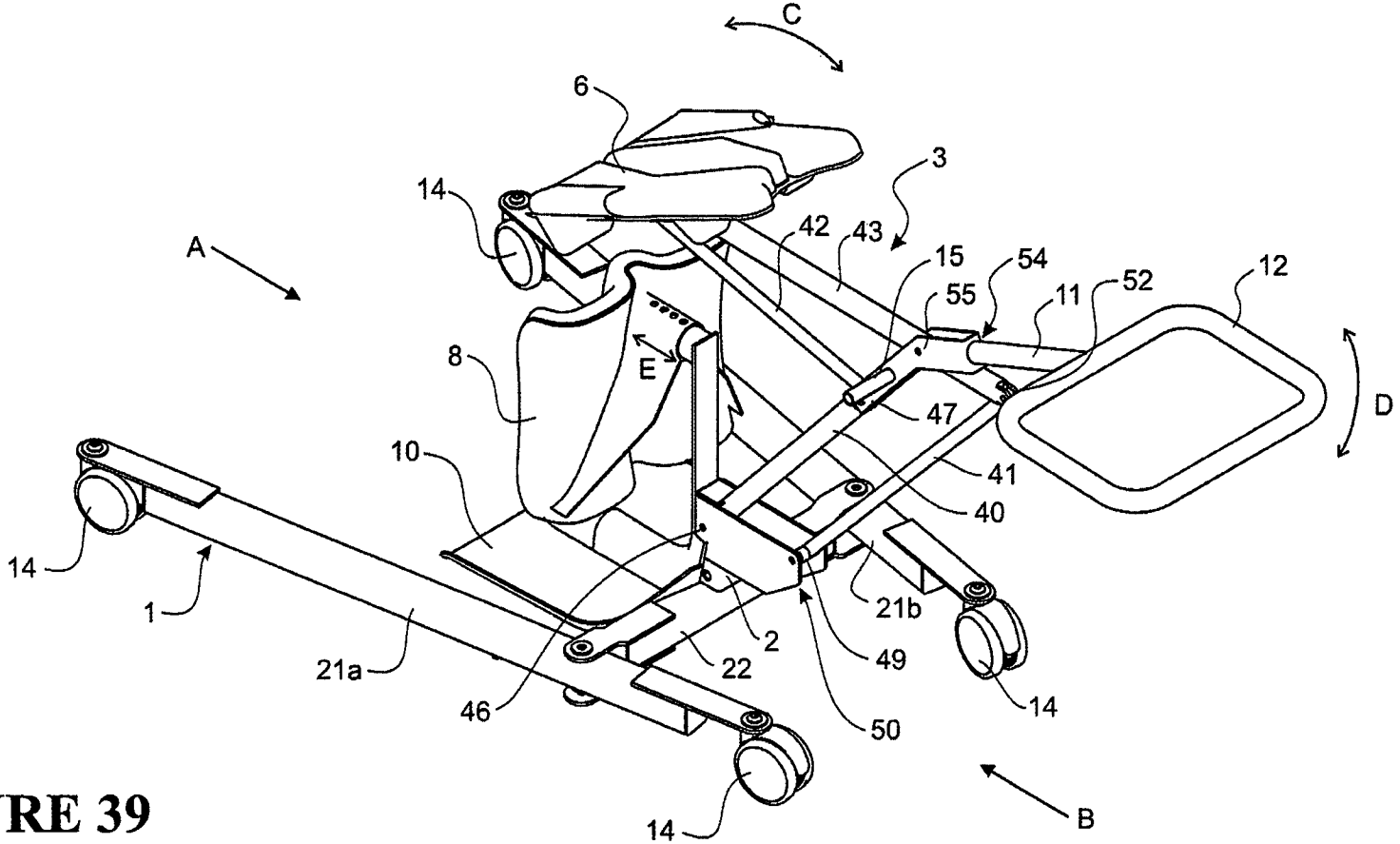
FIGS. 39-47 illustrate a sixth embodiment of the patient mover of the invention.
Figure 41:
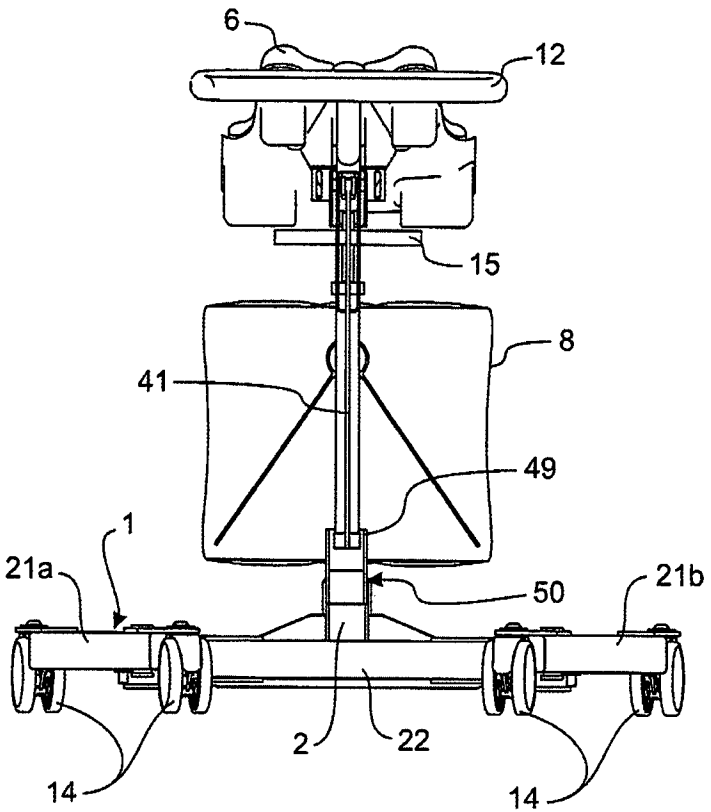
Figure 40:
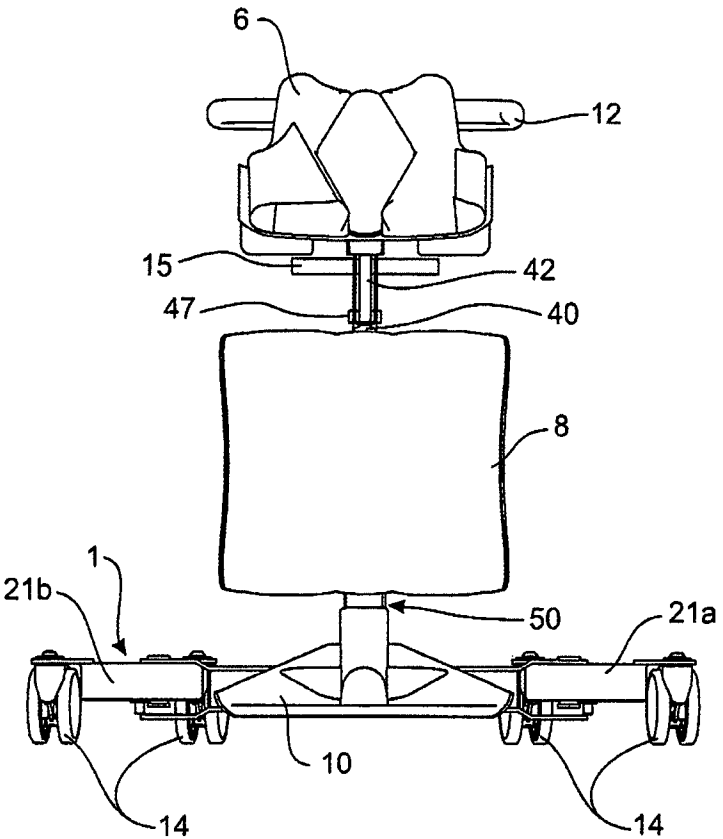
Figure 42:
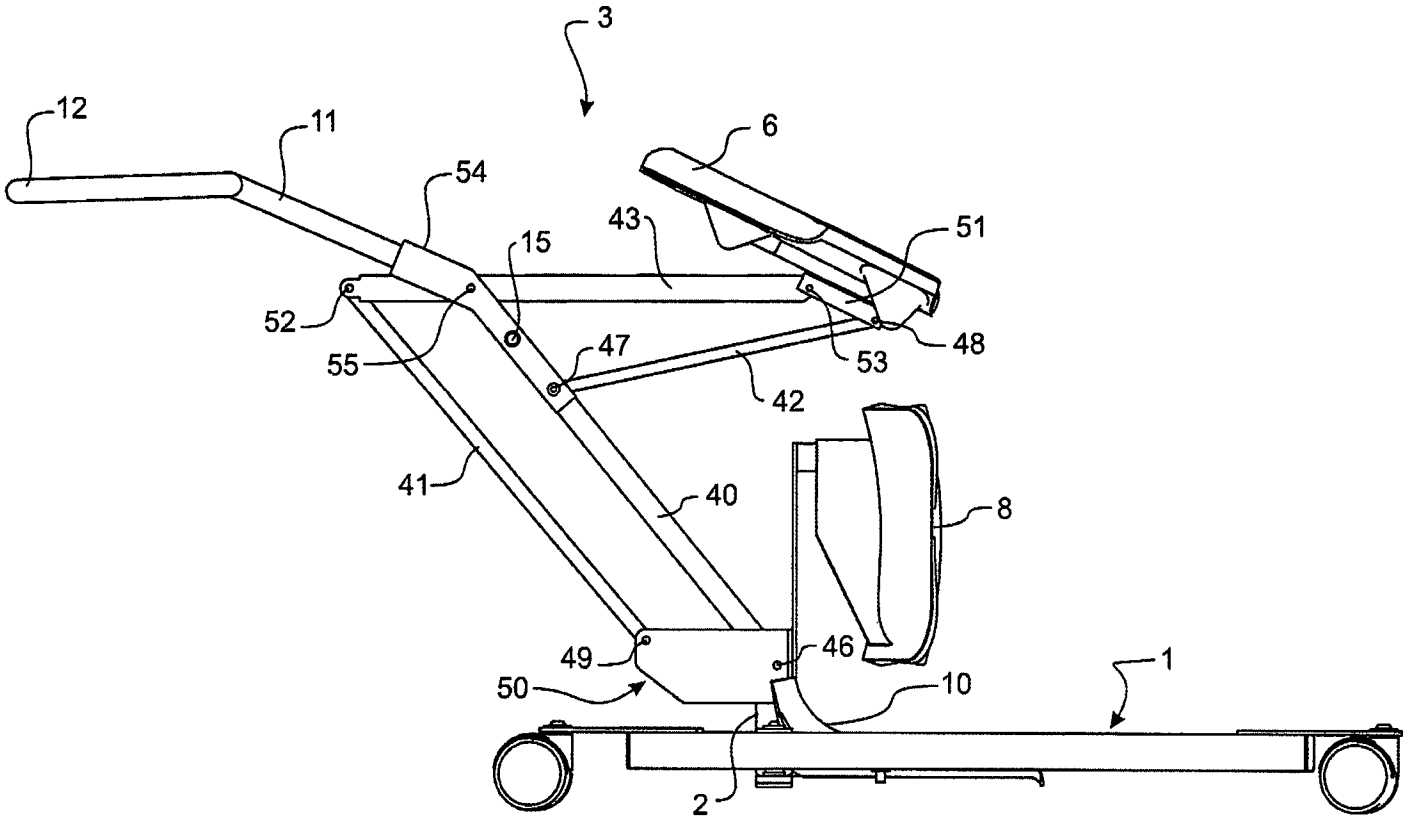

In this embodiment, the upper frame part 3 is in the form of a four-bar linkage or mechanism that is coupled to the lower frame part 1 and moveable via operation of handle 12 in the direction of arrow D to cause the patient engaging cradle 6 carried by the upper frame part 3 to move between load-unload and transport position as indicated by arrow C. Referring to FIGS. 39 and 42, the four-bar linkage comprises a lower pair of elongate links or bars 40, 41 that are pivotably connected to an upper pair of elongate links or bars 42, 43. In this embodiment, the lower pair of links comprised a first link 40 and longer second link 41 that are pivotably coupled so as to maintain a spaced apart and substantially parallel relationship with respect to each other throughout their movement path. The upper pair of links comprise a first link 42 and longer second link 43 that are pivotably coupled so as to maintain a spaced apart relationship with respect to each other throughout their movement path. The operative coupling and movement of the links 40-43 of the four-bar linkage will now be explained in further detail below.

The lower first link 40 is pivotably connected by a pivotable connection at 46 to a mounting component 50 provided on the upright element 2 of the lower frame part 1 and which is arranged to extend toward the carer side of the patient mover. The upright element 2 is substantially shorter than the previous embodiment. The opposite end of the lower first link 40 is pivotably connected at pivot connection 47 to an end of the upper first link 42. The opposite end of the upper first link 42 is pivotably connected at pivot connection 48 to a cradle mounting component 51 fixed or provided on the underside surface of the cradle 6. The lower second link 41 is pivotably connected at pivot connection 49 at the mounting component 50 and is positioned further toward the carer side of the patient mover than the lower first link 40. The opposite end of the lower second link 41 is pivotably connected at pivot connection 52 to an end of the upper second link 43. The opposite end of the upper second link 43 is pivotably connected at pivot connection 53 to the cradle mounting component 51 of the cradle 6. As shown, the upper second link 43 is located above the upper first link.

In this embodiment, the handle 12 is operatively connected to the four-bar linkage so that the linkage can be moved to carry the cradle 6 between load-unload and transport positions. In this embodiment, the handle 12 extends from the lower first link 40. More specifically, the handle 12 is mounted to an end of an arm 11 and the opposite end of the arm is fixed or coupled to a handle mounting component 54 extending from the end of the lower first link 40 at the pivot connection 47 between lower and upper first links 40,42. Additionally, the handle mounting component 54 is pivotably coupled at pivot connection 55 to the upper second link 43. In this embodiment, the pivot connection 55 is located between the pivot connections 52 and 53 on the upper second link 43 and preferably at or toward the pivot connection 52. In this embodiment, a handle or handles 15 for the patient to grip extend laterally from either side of the handle mounting component 54 or may be located at any other suitable position on the device.

Figure 43:
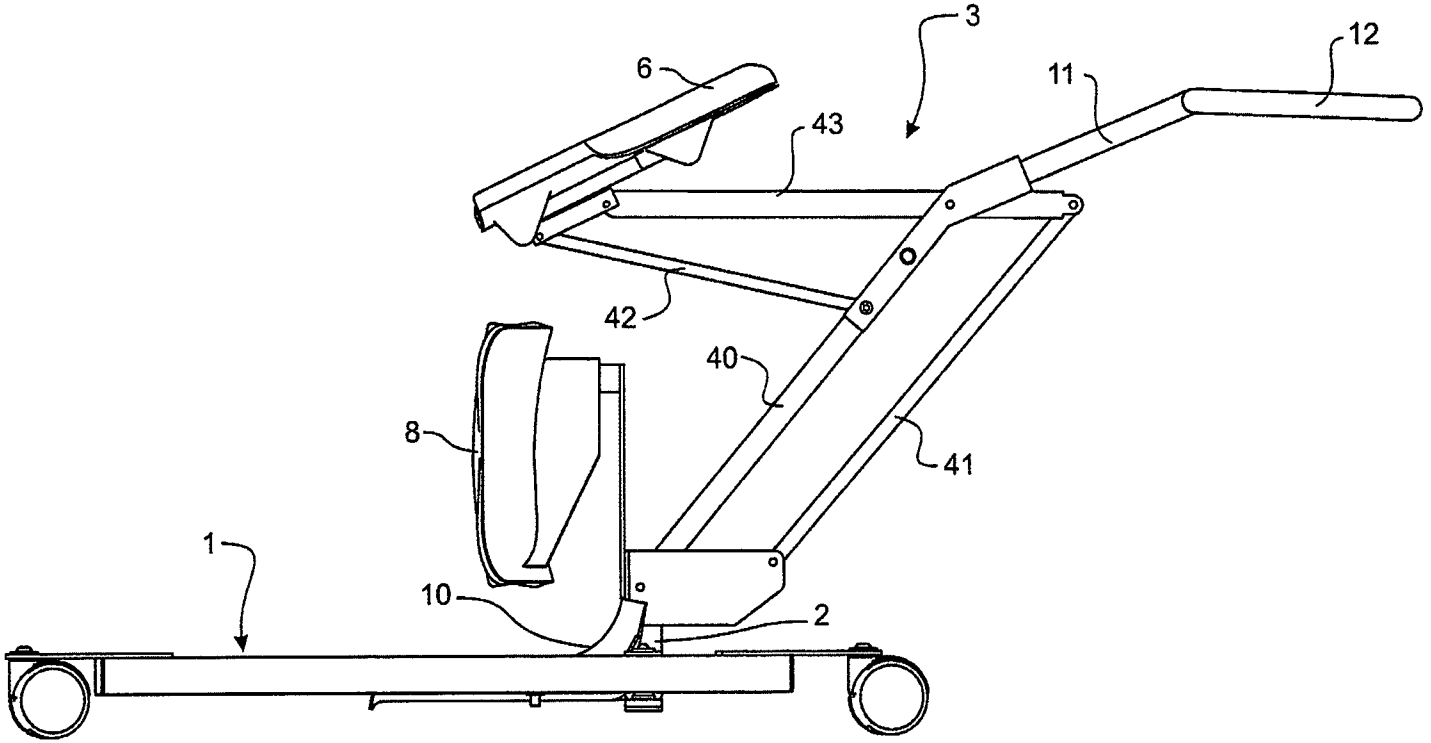
Figure 44:
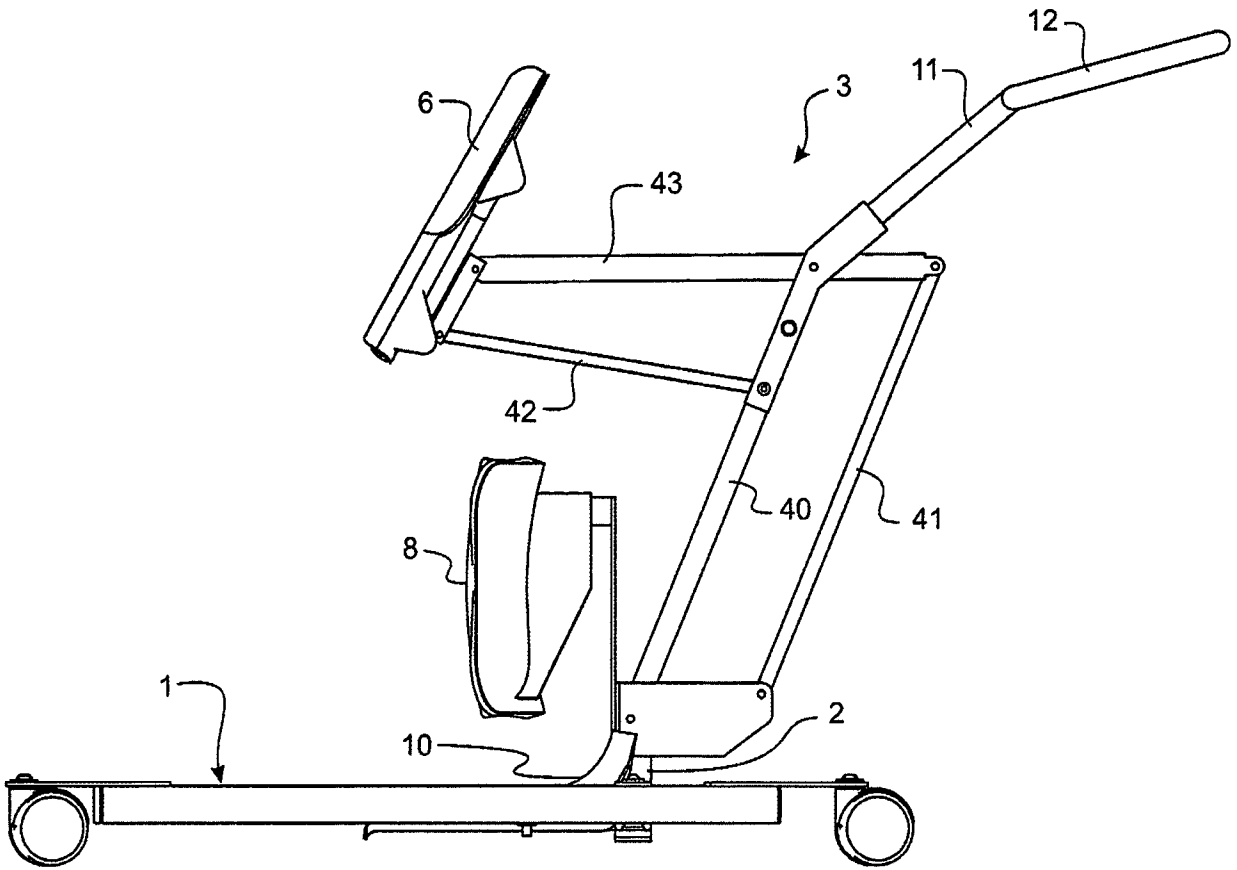
Figure 45:
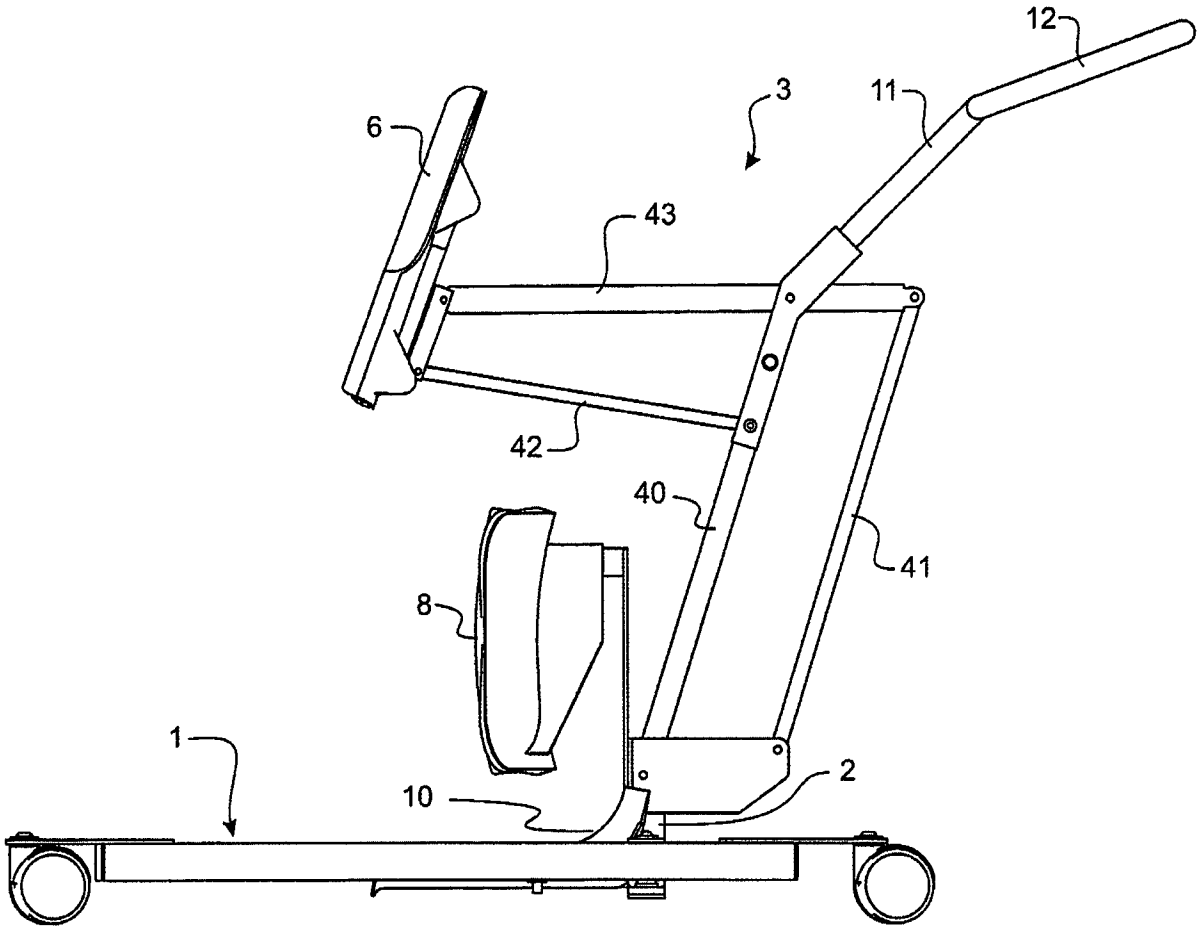
Figure 46:
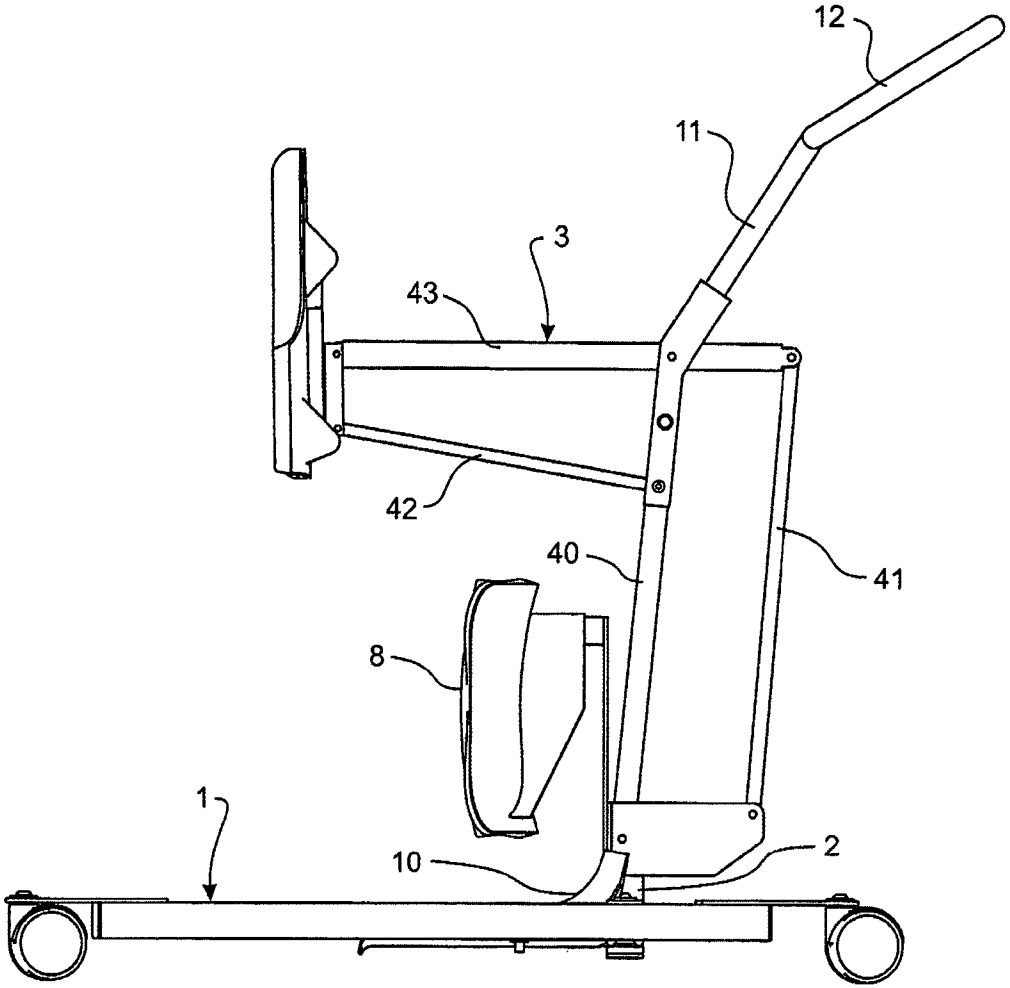

As shown in FIGS. 43-46, the four-bar linkage moves from a substantially un-collapsed state when the patient mover is in the load-unload position (FIG. 46) toward a collapsed state when the patient mover is in the transport position (FIG. 43). The term 'collapsed' is intended to mean that the respective lower links 40,41 and upper links 42,43 each move closer together in their upper and lower pairs, or that the distance between at least a portion of the links in each pair reduces, and vice versa for un-collapsing with the distance increasing with respect to at least a portion of the links in each pair.

Figure 47:
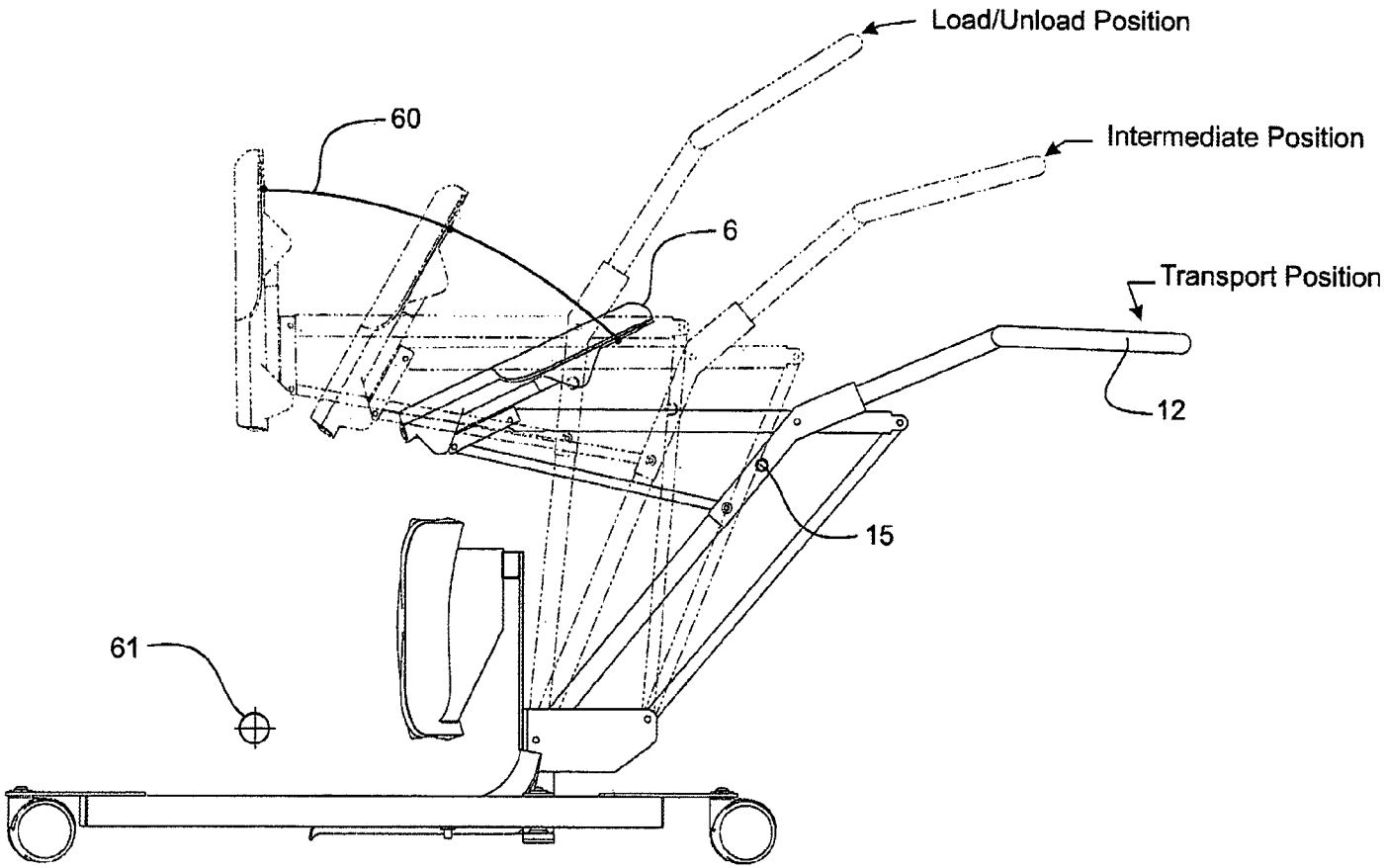

With reference to FIG. 47, as in previous embodiments the carer may move the handle 12 upward and downward to cause the cradle 6 to move between the load-unload and transport positions. As with the previous embodiments, the four-bar linkage is configured to cause the cradle 6 to move in a curvilinear path. In the preferred form, the curvilinear path is an arc 60 that is centered about a virtual axis 61. In this preferred embodiment, the arc is defined as the path through which the point on the cradle 6 that contacts the top of the patient's sternum travels and preferably the virtual axis passes through or is parallel with a line across the patient when the patient is in the load-unload position, intermediate between two vertical planes coincident with the knee and hip joints of the patient. More preferably, the virtual axis passes through the centre $\frac{1}{3}^{rd}$ of the distance between the two vertical planes coincident with the knee and hip joints of the patient.

It will be appreciated that other 4-bar linkage configurations or mechanisms may alternatively be used provided they provide the desired path of movement between the cradle and lower frame part of the device.

Seventh Embodiment

FIGS. 48-55 illustrate a seventh embodiment patient mover of the invention. The seventh embodiment patient mover is constructed in a similar manner to the fifth and sixth embodiments in relation to the lower frame part 1 and other features, and similar references indicate the same or equivalent elements. Again, the primary difference between the seventh embodiment and the fifth and sixth embodiments is the nature of the operative coupling between the lower frame part 1 and the upper frame part 3 that allows or causes the movement between the load-unload and transport positions as explained in the previous embodiments.

Figure 48:
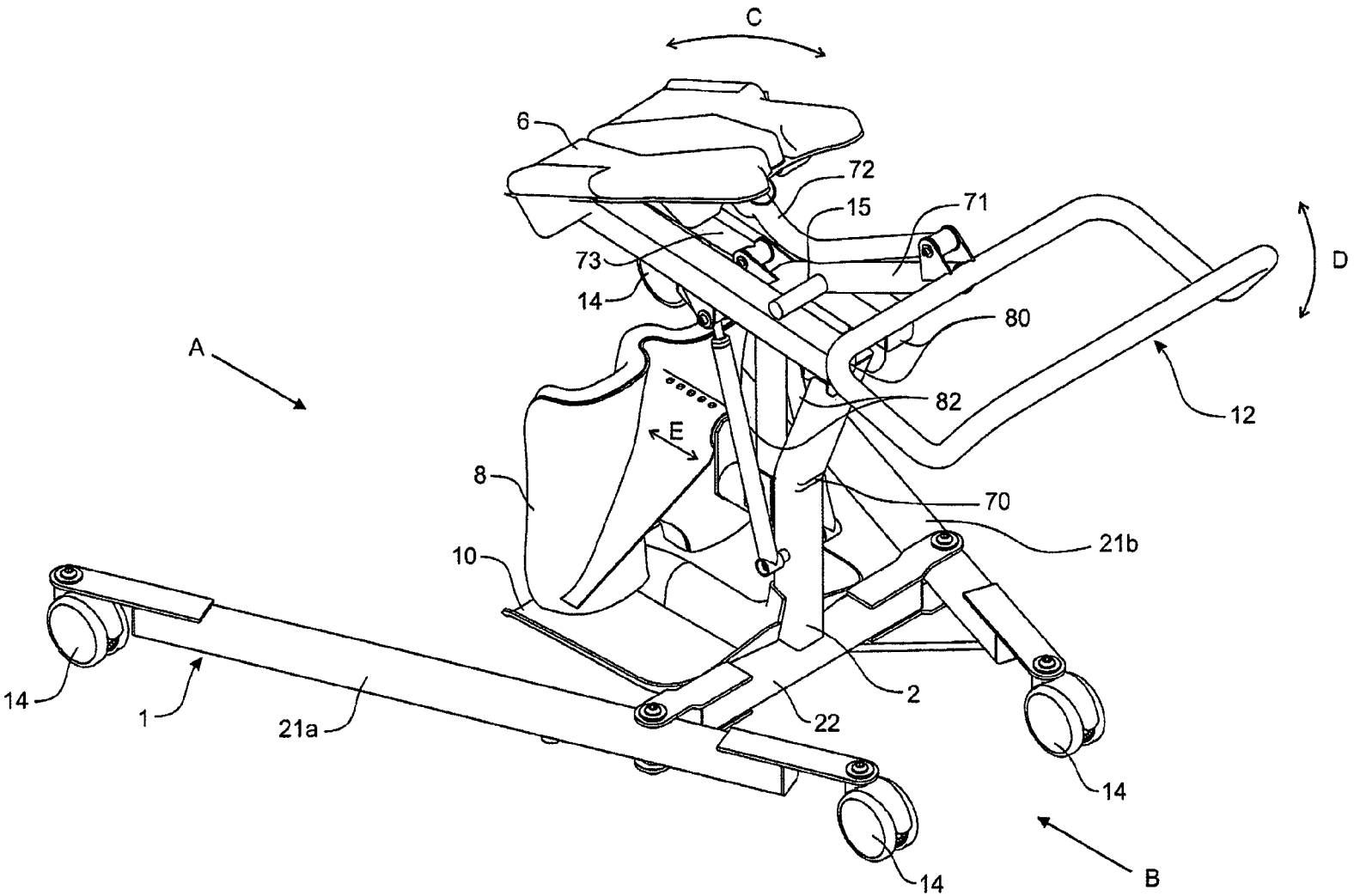
FIGS. 48-55 illustrate a seventh embodiment of the patient mover of the invention. Specifically.
Figure 50:
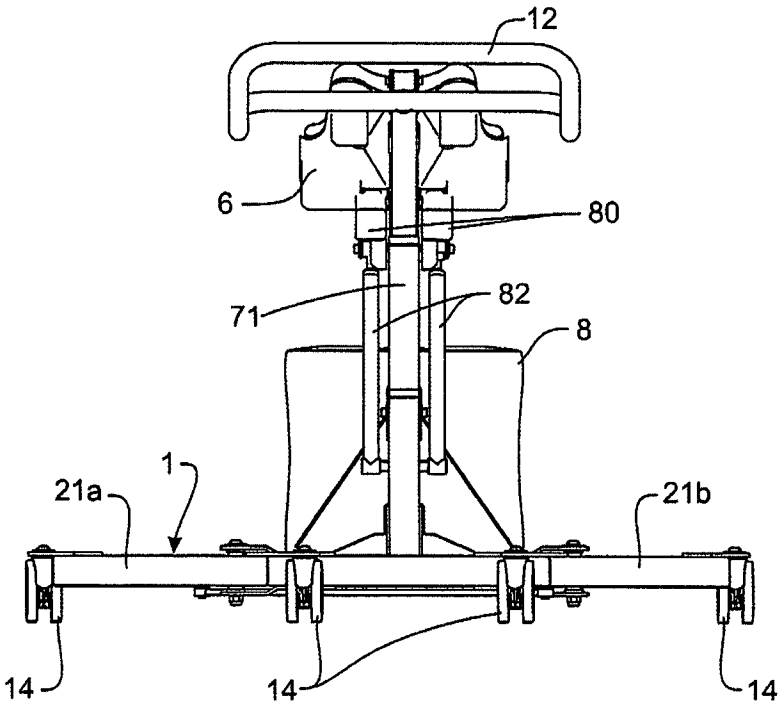
Figure 49:
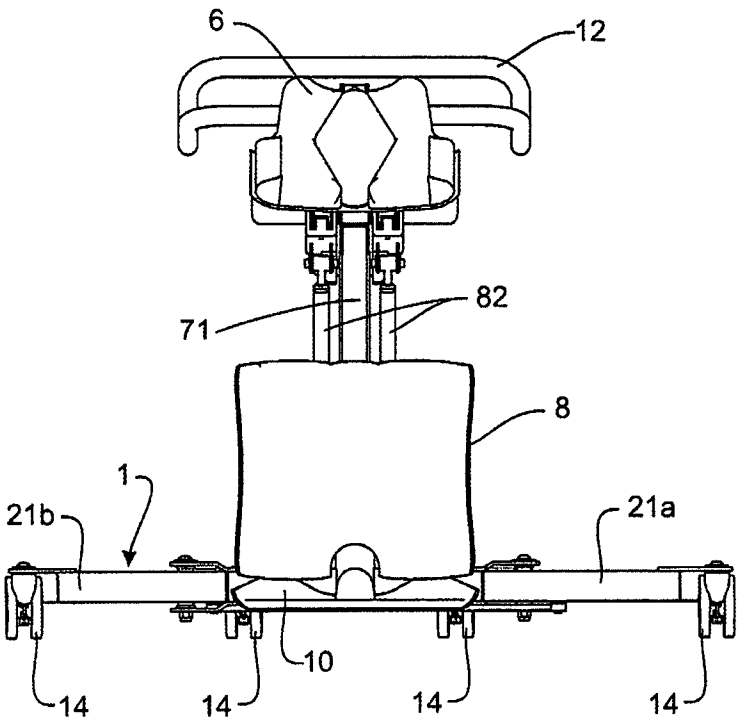
Figure 51:
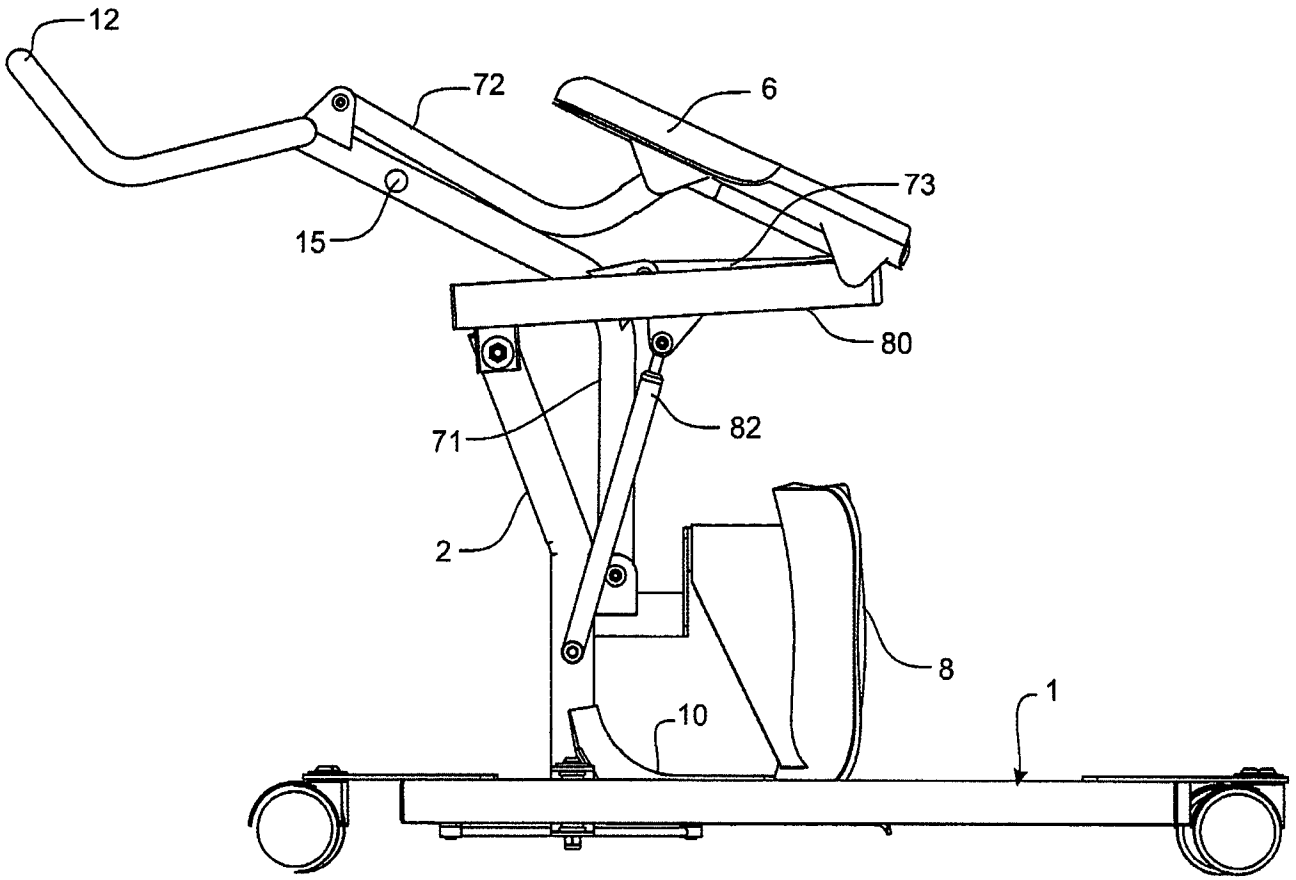
Figure 54:
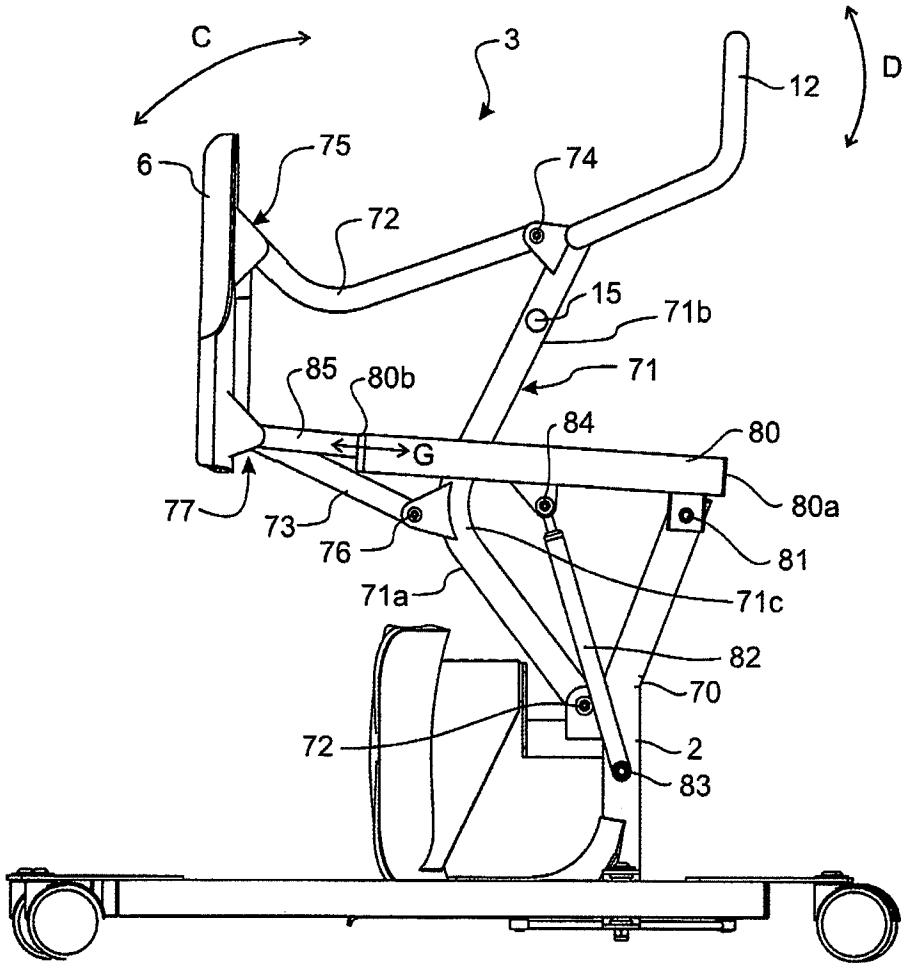

In this embodiment, the upright element 2 of the lower frame part 1 is bent toward the carer side of the patient mover at bending line 70 intermediate of its length. With reference to FIGS. 48 and 54, the construction and configuration of the upper frame part 3 which carries the cradle 6 will be explained in more detail. The upper frame part 3 comprises a pivot mechanism and slider mechanisms that cooperate to cause the desired curvilinear path of the cradle when the device is moved between the load-unload and transport positions.

The pivot mechanism comprises a centrally located pivot bar 71 that extends substantially upward relative to the lower frame part 1. In this embodiment, the pivot bar 71 is bent intermediate of its length toward the patient side of the patient mover. As shown in FIG. 54 with the patient mover in the load-unload position, the pivot bar 71 comprises a lower portion 71*a* that extends toward the patient side of the patient mover prior to the bent portion 71*c* and an upper portion 71*b* that extends back toward the carer side of the patient mover from the bent portion 71*c*. The lower end of the pivot bar 71 is pivotally coupled at pivot connection 72 to the upright element 2 of the lower frame part 1. In the preferred form, the pivot connection 72 is mounted or fixed to the upright element 2 at or toward the region of the bend 70. The handle 12 extends or is fixed to the opposite end of the pivot bar 71. A patient handle or handles 15 are provided at or toward the top end of the pivot bar 71 on either side of the patient mover for the patient to grip with their hands, although it will be appreciated that the handles may be provided in any other suitable location.

The pivot bar 71 is operatively connected to the cradle 6 by upper and lower connecting rods or members 72, 73. The upper and lower connecting members 72,73 are substantially aligned centrally in the same plane as the pivot bar 71 relative to the overall patient mover. In the preferred form, the upper connecting member 72 is bent intermediate of its length and at one end is pivotally connected at pivot connection 74 at or toward the upper end of the pivot bar 71. The opposite end of the upper connecting member 72 is pivotally connected at a pivot connection (not visible) centrally located on the underside of the cradle 6 in the region indicated by arrow 75 in or toward the upper or top region of the cradle 6. The lower connecting member 73 is a straight element in the preferred form and at one end is pivotally connected to the pivot bar 71 at pivot connection 76. The pivot connection 76 is fixed or mounted to the pivot bar 71 somewhere between pivot connections 72 and 74 and in the preferred form in the region of the bent portion 71*c* of the pivot bar. The opposite end of the lower connecting member 73 is pivotally connected at a pivot connection (not visible) that is centrally located on the underside of the cradle 6 in or toward the bottom or lower region of the cradle as indicated by arrow 77. With this pivot mechanism, the carer may operate the handle 12 to move the cradle 6 between the unload-load and transport positions in cooperation with a slider mechanism(s) that guides the movement as explained further below.

As mentioned above, the upper frame part 3 further comprise a slider mechanism(s) that assist the pivot mechanism to guide the cradle 6 through a curvilinear path between the load-unload and transport positions. In the preferred embodiment, two identical slider mechanisms are provided on each side of the patient mover, although it will be appreciated that the device could operate with a single slider mechanism in alternative embodiments. In the preferred embodiment the slider mechanisms are spaced apart and substantially parallel to each other on either side of the pivot mechanism such that the pivot bar 71 and connecting members 72 and 73 move in the space provided centrally between the slider mechanisms. More particularly, the slider mechanisms components are situated and operate in planes that are substantially parallel to that of the central plane of operation of the pivot mechanism, which is situated along the central line of symmetry of the device.

With reference to FIG. 54, the left side (carer view) slider mechanism will be explained in further detail. The slider mechanism comprises a guide component 80 that is fixed in a substantially horizontal or slightly angled orientation relative to the horizontal when the patient mover is in use, although its position and orientation may be adjusted in some embodiments. The guide component 80 is elongate and extends between a first end 80*a* that is connected to at connection 81 at or toward the upright element 2 of the lower frame part 1 and a second end 80*b*. In the embodiment shown, the guide component 80 is supported by a length adjustable telescopic strut 82 that is pivotally connected at one end at pivot connection 83 to the upright element 2 of the lower frame part 1 and at the opposite end to a pivot connection 84 fixed or mounted to the guide component 80 in a position intermediate of its length between ends 80*a*,80*b*. In this embodiment, the connection 81 between the first end 80*a* of the guide component and upright element 2 is a pivotal connection such that the length of the telescopic strut may be adjusted to modify the orientation of the guide components 80 relative to the horizontal if desired. In alternative embodiments, the guide component may be fixedly mounted at connection 81 to the upright element 2 by welding or any other suitable connection, and the telescopic strut may be replaced with a support brace or strut that is fixed in length for additional support, or alternatively guide component 80 may be cantilevered from the upright element 2 without any additional supporting struts or braces in a further alternative embodiment.

As shown the first end 80*a* of the guide component is located at or toward the carer side of the patient mover and extends to the second end 80*b* at or toward the patient side. The slider mechanism further comprises a slider rod or member 85 that is pivotally coupled at one end to the lower or bottom end region of the cradle 6 as indicated by arrow 77 and toward the left side of the cradle. The opposite end of the slider member 85 is operatively connected to the guide component 80 for linear slideable movement relative to the guide component in the direction of arrow G. In this embodiment, the guide component is substantially hollow and of sufficient internal diameter such that the slider member 85 is slideably received and retained for reciprocating movement back and forward in the direction of arrow G within and along the guide component 80 as the patient mover moves between the load-unload and transport positions. In the preferred embodiment, one or more roller wheels are provided underneath the slider member for rollably engaging with a lower internal surface of the guide component 80 to assist the slidable movement or alternatively one or more rollers may be mounted within the guide component upon which the slider member 85 may travel. It will be appreciated that any other slidable configuration between the guide component 80 and slider member 85 may be provided, whether telescoping or otherwise. The right side slider mechanism is a mirrored version to the left side slider mechanism with the same components and configuration.

Figure 55:
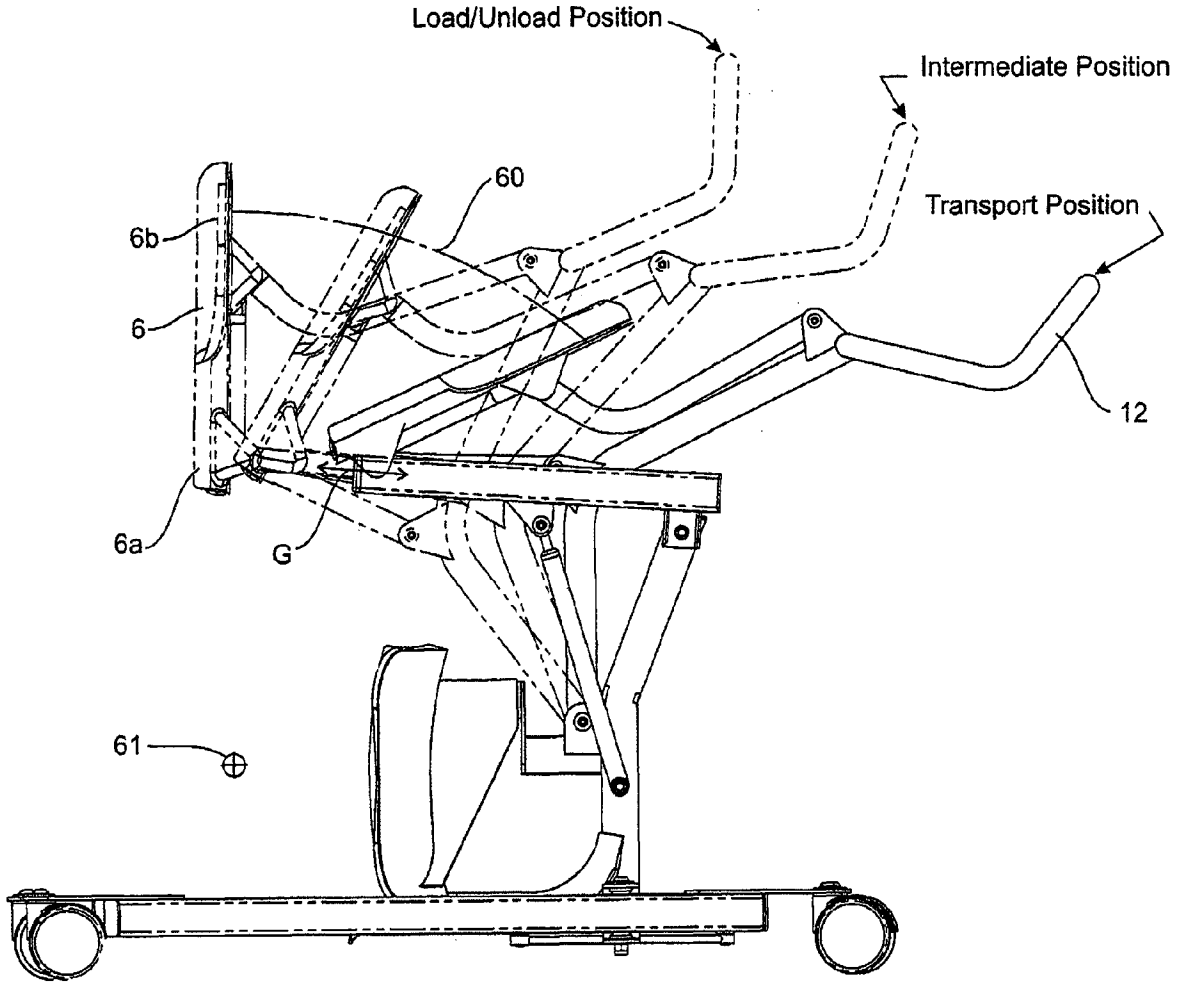

As mentioned, the pivot mechanism and slider mechanism(s) of the upper frame part 1 cooperate together to move the cradle through a curvilinear path between the load-unload and transport positions when the handle 12 is operated. With reference to FIG. 55, in this embodiment, movement of the handle 12 from the load-unload position to the transport position causes the lower end of the cradle shown at 6*a* to translate or slide linearly in direction of arrow G from the patient side toward the carer side while simultaneously the upper end 6*b* of the cradle 6 is caused to move through a curvilinear path shown at 60, and vice versa when the moving from the transport position back to the load-unload position. In addition to guiding the movement of the lower region of the cradle, the twin slider mechanisms on each side of the patient mover are configured to carry the load of the patient in the cradle in that the load is transferred to the guide components 80 of each of the slider mechanisms.

Figure 52:
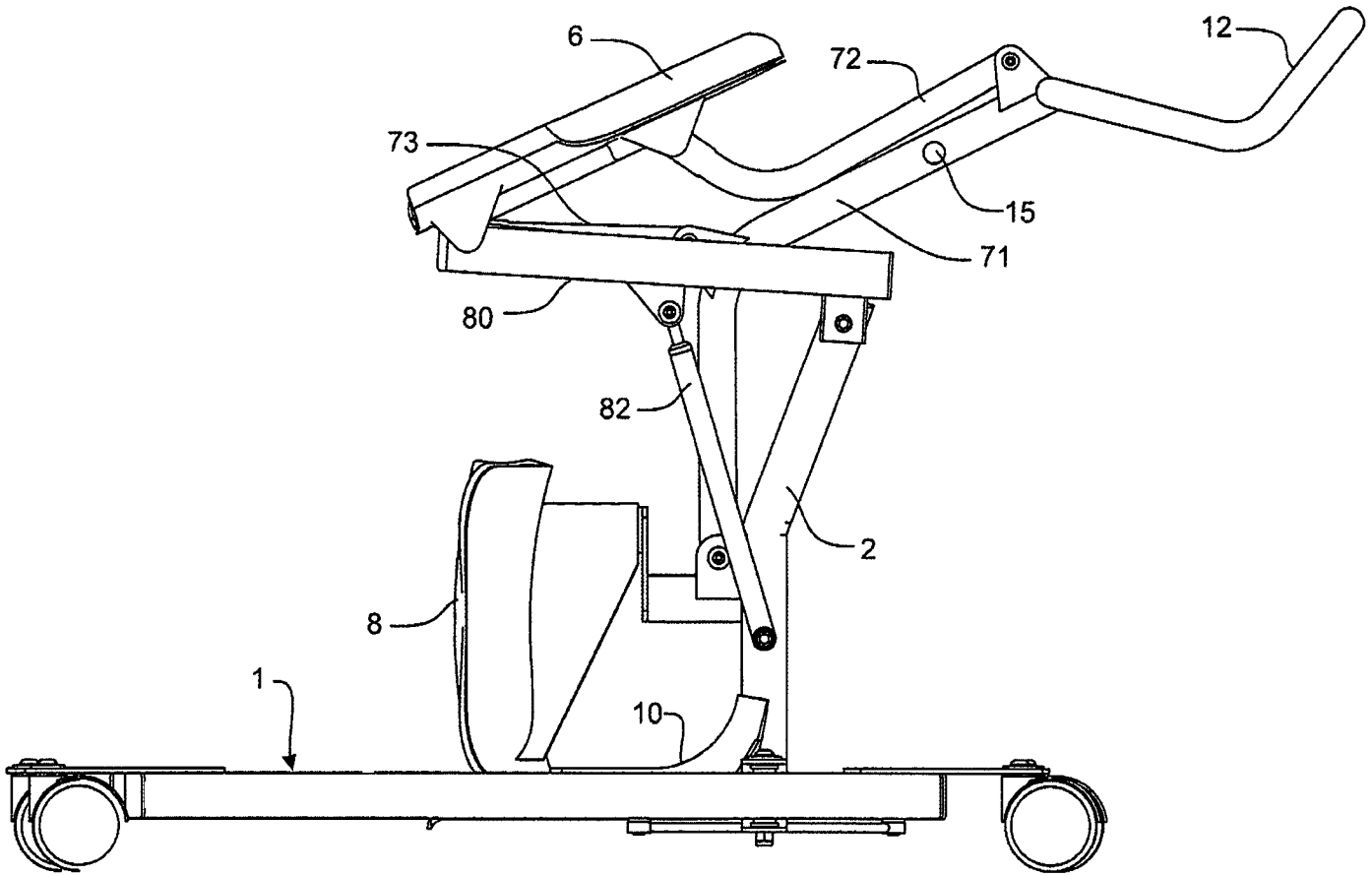
Figure 52A:
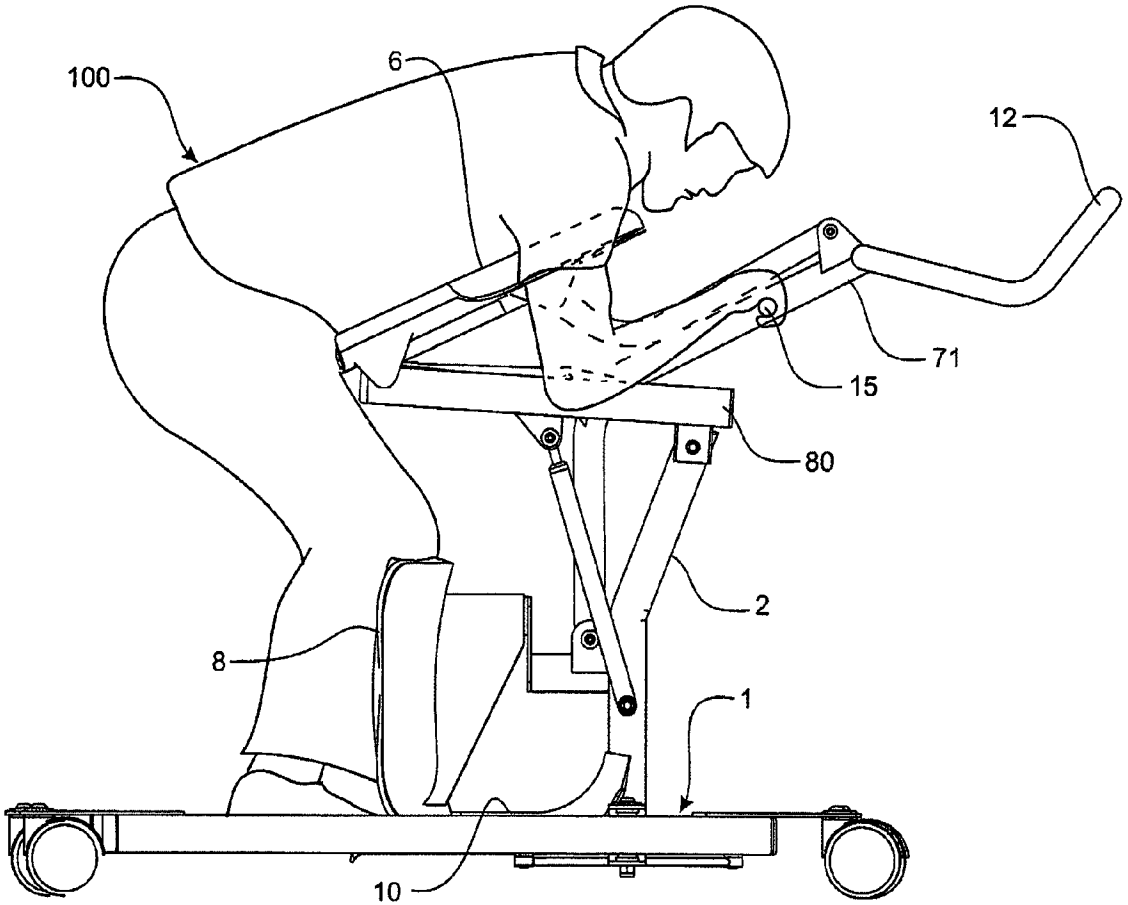
FIG. 52A shows the seventh embodiment patient mover of FIG. 52 with a patient onboard in the transport position.
Figure 53:
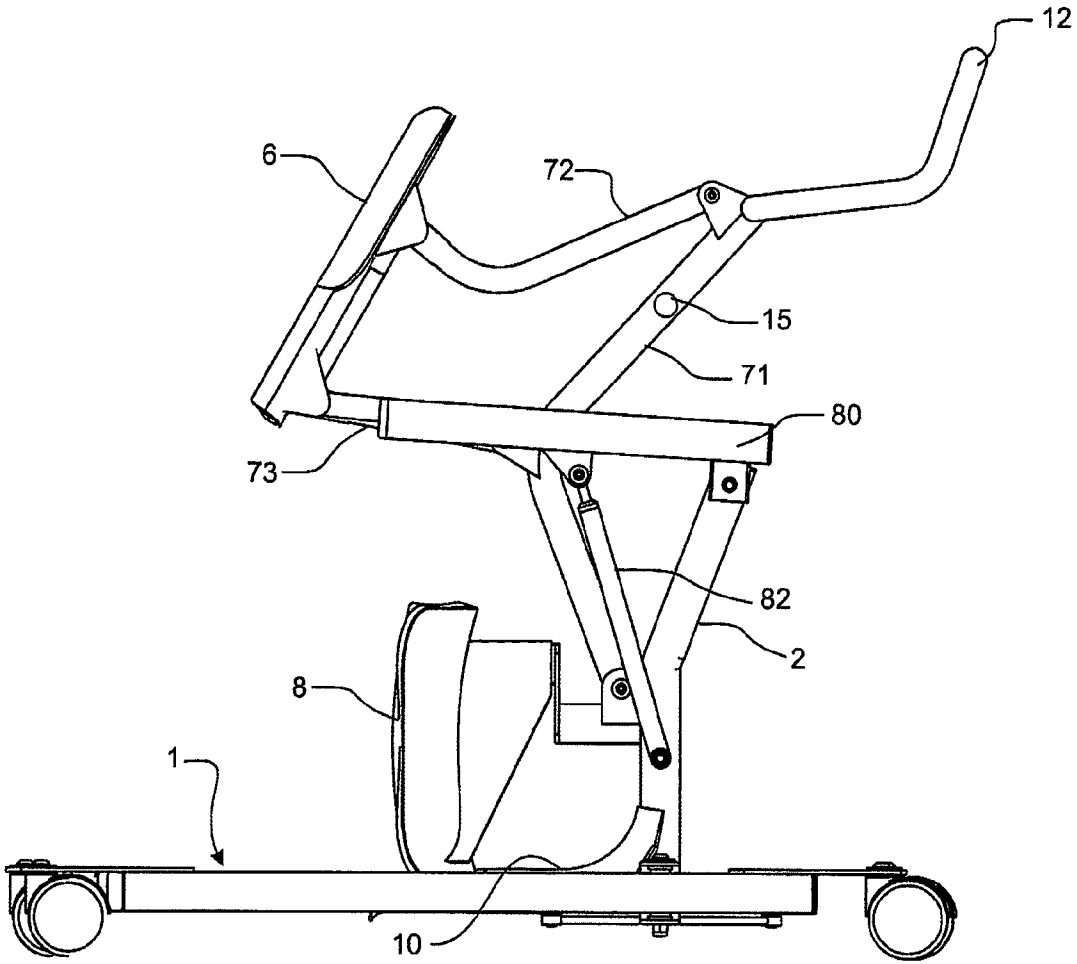
Figure 54A:
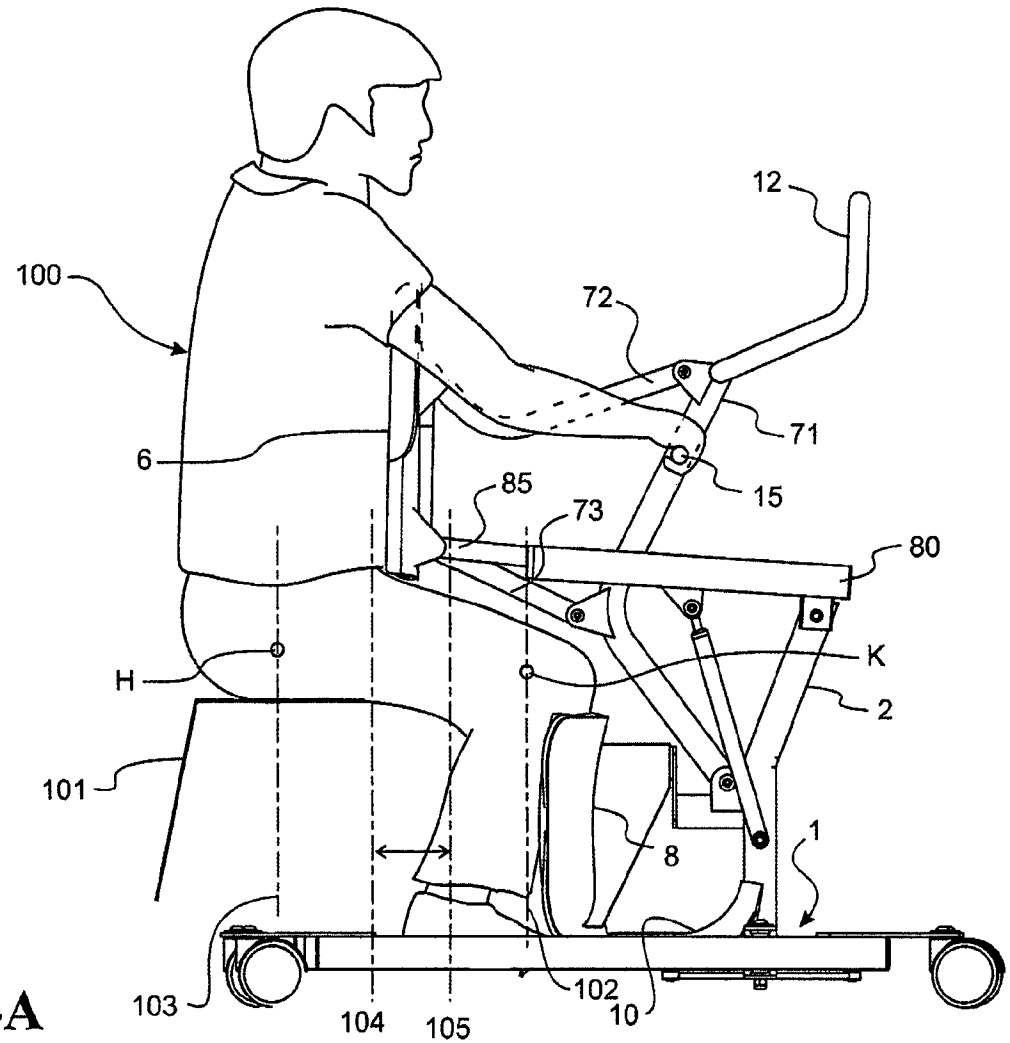
FIG. 54A shows the seventh embodiment patient mover of FIG. 54 with a patient onboard in the load-unload position.

Like the other embodiments, the curvilinear path is an arc 60 that is centered about a virtual axis 161. Preferably, the arc 60 is defined by the path of movement of a point on the cradle 6 that corresponds to where the top of the patient's sternum abuts the cradle and the virtual axis 61 passes through or is parallel with a line across the patient when the patient is seated in the load-unload position, intermediate between two vertical planes coincident with the knee and hip joints of the patient. More preferably, the virtual axis passes through the centre $1/3^{rd}$ of the distance between the two vertical planes coincident with the knee and hip joints of the patient when seated in load-unload position. By way of example, FIG. 54A shows a patient 101 in the load-unload position, seated on a chair 101 and engaged with the patient mover, with the two vertical planes 102,103 of the knee (K) and hip (H) joints marked. The center $1/3^{rd}$ region in which the virtual axis is located is marked between planes 104 and 105. FIG. 52A shows the patient in the transport position, by way of example only.

Other Aspects of the Embodiments

All embodiments are configured to move the patient in a manner substantially similar to that described with reference to FIG. 10 and the first embodiment. More particularly, each embodiment of the patient mover comprises an upper patient carry part (e.g. cradle or patient carrier component 6 that engages with the patient's torso) that is adapted to move the top of the patient's sternum (S) in a curvilinear path, such as an arc Ax-y, about a center located at axis Px-y, which may be a real pivot axis in some embodiments (first and third) or a virtual axis in other embodiments (second, fourth, fifth, sixth and seventh). As previously described, the patient mover is configured preferably such that the axis Px-y remains in the center ⅓rd of the distance between the two vertical planes coincident with the patient's knee and hip joints when they are seated in the load-unload position. This configuration causes the patient's torso to move by substantially rolling about a line across the device and the patient such that the center of mass of the patient translates horizontally through a shallow arc with minimal lifting or lowering of the center of mass vertically.

In all embodiments the movement of the patient from the load-unload position to the transport position and from the transport position to the load-unload position may include a component of lifting and lowering respectively of the centre of mass of the patient as well as rolling, but if so the lifting and lowering of the patient is less than 5%, preferably less than 2% of the height of the patient. Preferably the lifting component of movement is not more than 85 mm and more preferably not more than 35 mm in a vertical direction.

In any embodiment of the patient mover of the invention described above a strap may be provided which can be passed from one side of the patient mover around the patient's back to the other side and secured, to ensure that the patient cannot fall from the patient mover during movement. While this is not necessary to lift the patient and virtually no strength is required from the patient it may be useful for elderly or infirm patients where there is fear of falling or for patients who may have a spasm, or in confusion may try to step off the patient mover during transport.

When a patient is on the patient mover most of the patient's weight is carried through the cradle or patient carrier component 6/7, and through the patient's chest or torso which engages the cradle and under the arms, but in an alternative embodiment a strap may be provided which can be passed by a caregiver from one side of the device beneath the patient's buttocks to be fixed on the opposite side of the device, to assist in carrying some of the patient's weight and reducing pressure under the arms. Once the patient has been moved and placed, on a chair for example, the caregiver may readily pull the strap out from underneath the patient.

The embodiments are shown by way of example only and may be otherwise constructed for example from sheet metal in a monocoque construction for example.

It will be appreciated that various features described with regard to only one embodiment may also apply or could be incorporated in the same or an equivalent structural or functional form into some or all of the other embodiments if desired.

The foregoing describes the invention including preferred forms thereof. Modifications may be made thereto without departing from the scope of the invention as defined by the accompanying claims.

The invention claimed is:

1. A person moving device (patient mover) for moving a patient of limited mobility, the device having a patient side and a user side and comprising:

a lower floor engaging frame part, upper patient carrying part adapted to carry a patient by engaging the patient's torso from the front, mounted to the lower frame part for movement between a patient load-unload position and a patient transport position in which the patient's buttocks are elevated relative to the load-unload position, the upper patient carrying part being mounted to the lower frame part by a 4-bar linkage that is configured to enable curvilinear movement of a point on the upper patient carrying part that abuts the top of the patient's sternum through a curvilinear path about virtual axis extending across the patient and positioned such that it passes through the center ⅓rd of the distance between the two vertical planes coincident with the knee and hip joints of the patient when the patient is in the load-unload position so that the patient's torso moves substantially by rolling about an axis across the device and the patient and substantially about a center of mass of the patient such that any vertical movement of the center of mass of the patient when moving from the load-unload position to the transport position, or vice versa, is less than approximately 5% of the height of the patient, and a handle by which a user can cause the upper patient carrying part to move from the load-unload position to the transport position, and wherein the 4-bar linkage comprises links that are pivotably connected by pivotable connections such that all the pivotable connections are located forward, in the direction extending from the patient side to the user side of the device, of a vertical plane extending across the device through the virtual axis, throughout all movement positions of the upper patient carrying part along the curvilinear path between the patient load-unload position and the patient transport position.

2. A person moving device according to claim 1 wherein the curvilinear movement of the upper patient carrying part follows an arc centered about the virtual axis.

3. A person moving device according to claim 1 wherein any vertical movement of the center of mass of the patient when moving from the load-unload position to the transport position, or vice versa, is not more than approximately 85 mm.

4. A person moving device according to claim 1 wherein the lower frame part comprises a floor for supporting the patient's feet, and a lower leg contacting part or parts for supporting each of the patient's lower legs.

5. A person moving device according to claim 4 wherein the lower leg contacting part(s) are adjustable in position on the lower frame part.

6. A person moving device according to claim 1 wherein the device further comprises an operable latching mechanism that is operable by a user to lock the upper patient carrying part in one or more positions relative to the lower frame part.

7. A person moving device according to claim 1 wherein the lower frame part comprises one or more ground wheels for transporting the device over the ground.

8. A person moving device according to claim 1 wherein the upper patient carrying part is in the form of a cradle comprising upwardly extending arms on either side of the cradle to assist in locating the patient.

9. A person moving device according to claim 1 wherein the upper patient carrying part is in the form of a chest pad that is shaped for supporting a patient's torso.

10. A person moving device according to claim 1 wherein the device further comprises one or more stop mechanisms that are configured to limit the range of movement of the upper patient carrier part relative to the lower frame part to between the load-unload and transport positions.

11. A person moving device according to claim 1 wherein the handle is operatively connected to the 4-bar linkage, and the 4-bar linkage is configured such that movement of the handle causes the 4-bar linkage to move the upper patient carrying part between the load-unload and transport positions.

12. A person moving device according to claim 1 wherein the 4-bar linkage moves toward a collapsed state when moving toward the transport position, and an un-collapsed state when moving toward the load-unload position.

13. A patient moving device according to claim 1 wherein any vertical movement of the center of mass of the patient when moving from the load-unload position to the transport position, or vice versa, is less than approximately 2% of the height of the patient.

14. A patient moving device according to claim 1 wherein any vertical movement of the center of mass of the patient when moving from the load-unload position to the transport position, or vice versa, is not more than approximately 35 mm.

15. A person moving device according to claim 1 wherein the device further comprises one or more patient handles for the patient to grip mounted in the vicinity of the upper patient carrying part.

16. A person moving device according to claim 1 wherein the 4-bar linkage comprises a first pair of first and second links that are each pivotably connected to the lower frame part at one end, the opposite ends of the first pair of first and second links being pivotably connected to respective ends of a second pair of first and second links, the opposite ends of the second pair of first and second links being pivotably connected.

17. A person moving device according to claim 16 wherein the upper patient carrying part is mounted to a link of the 4-bar linkage.

18. A person moving device according to claim 1 wherein the handle extends from the upper patient carrying part.

* * * * *